US009658027B2

(12) United States Patent
Stevens

(10) Patent No.: US 9,658,027 B2
(45) Date of Patent: May 23, 2017

(54) COMPRESSED GAS GUN HAVING BUILT-IN, INTERNAL PROJECTILE FEED MECHANISM

(71) Applicant: GI SPORTZ DIRECT LLC, Sewell, NJ (US)

(72) Inventor: Simon B. Stevens, Sewell, NJ (US)

(73) Assignee: GI SPORTZ DIRECT LLC, Sewell, NJ (US)

( * ) Notice: Subject to any disclaimer, the term of this patent is extended or adjusted under 35 U.S.C. 154(b) by 0 days.

(21) Appl. No.: 14/309,958

(22) Filed: Jun. 20, 2014

(65) Prior Publication Data

US 2014/0373823 A1 Dec. 25, 2014

Related U.S. Application Data

(60) Provisional application No. 61/837,984, filed on Jun. 21, 2013, provisional application No. 61/891,781, filed on Oct. 16, 2013.

(51) Int. Cl.

| | |
|---|---|
| ***F41B 11/53*** | (2013.01) |
| ***F41B 11/51*** | (2013.01) |
| ***F41B 11/71*** | (2013.01) |

(52) U.S. Cl.

CPC ..... *F41B 11/51* (2013.01); *F41B 11/71* (2013.01)

(58) Field of Classification Search

CPC F41B 11/53; F41B 11/57; F41B 11/52; F41B 11/721; F41B 11/50

USPC ..... 124/41.1, 51.1, 72–77, 56

See application file for complete search history.

(56) References Cited

U.S. PATENT DOCUMENTS

| | | | |
|---|---|---|---|
| 1,332,992 | A | 3/1920 | Moore et al. |
| 1,332,993 | A | 3/1920 | Moore et al. |
| 1,403,689 | A | 1/1922 | Hyndman |
| 1,403,719 | A | 1/1922 | Szepe |
| 1,404,689 | A | 1/1922 | Fairweather |
| 1,743,576 | A | 1/1930 | Smith |

(Continued)

FOREIGN PATENT DOCUMENTS

| | | |
|---|---|---|
| CA | 2625799 | 1/2011 |
| DE | 876370 | 5/1953 |

(Continued)

OTHER PUBLICATIONS

Warpig—World And Regional Paintball Information Guide, http://www.warpig.com/paintball/technical/loaders/halo/index.shtml, warpig.com, Odyssey Readies Halo for Production, by Bill Mills, Jun. 2001, pp. 1 to 6.

(Continued)

*Primary Examiner* — Michael David

(74) *Attorney, Agent, or Firm* — Volpe and Koenig, P.C.

(57) ABSTRACT

A compressed gas gun is provided, wherein the body houses a firing assembly and an internal, built-in projectile feed mechanism. The projectile feed mechanism is preferably formed as a rear or butt stock of the compressed gas gun. The projectile feed mechanism preferably feeds projectiles to the firing assembly via a feed ramp having an S-shaped transition portion. The compressed gas gun preferably includes a removable top feed rail assembly that can be removed to expose the interior of the compressed gas gun body for field stripping. Central control circuitry is preferably provided for controlling both the firing assembly and the projectile feed mechanism.

10 Claims, 34 Drawing Sheets

(56) References Cited

U.S. PATENT DOCUMENTS

| | | | |
|---|---|---|---|
| 1,867,513 | A | 7/1932 | Lahti |
| 1,954,093 | A | 4/1934 | Nelson |
| 2,064,888 | A | 12/1936 | Dickinson |
| 2,307,015 | A | 1/1943 | Boynton |
| 2,338,984 | A | 1/1944 | Van Horn et al. |
| 2,357,951 | A | 9/1944 | Hale |
| 2,398,263 | A | 4/1946 | Trimbach |
| 2,451,521 | A | 10/1948 | Uglum |
| 2,526,969 | A | 10/1950 | Powers |
| 2,568,432 | A | 9/1951 | Cook |
| 2,639,904 | A | 5/1953 | McMaster et al. |
| 2,641,412 | A | 6/1953 | Byberg |
| 2,676,633 | A | 4/1954 | Lohre et al. |
| RE23,951 | E | 2/1955 | Graham |
| 2,716,973 | A | 9/1955 | Desi |
| 2,900,972 | A | 8/1959 | Marsh et al. |
| 3,089,476 | A | 5/1963 | Wolverton |
| 3,134,301 | A | 5/1964 | Even |
| 3,248,008 | A | 4/1966 | Meierjohan |
| 3,273,553 | A | 9/1966 | Doyle |
| 3,384,354 | A | 5/1968 | Migule et al. |
| 3,410,453 | A | 11/1968 | Lawrence |
| 3,467,073 | A | 9/1969 | Rhodes |
| 3,610,223 | A | 10/1971 | Green |
| 3,630,118 | A | 12/1971 | Stoner |
| 3,695,246 | A | 10/1972 | Filippi et al. |
| 3,724,437 | A | 4/1973 | Halstead |
| 3,745,687 | A | 7/1973 | Koon, Jr. |
| 3,766,901 | A | 10/1973 | Cleary et al. |
| 3,777,732 | A | 12/1973 | Holloway et al. |
| 3,788,298 | A | 1/1974 | Hale |
| 3,789,891 | A | 2/1974 | Bosch |
| 3,807,379 | A | 4/1974 | Vodinh |
| 3,814,283 | A | 6/1974 | Cioth |
| 3,844,267 | A | 10/1974 | Mohr |
| 3,855,988 | A | 12/1974 | Sweeton |
| 3,867,921 | A | 2/1975 | Politzer |
| 3,894,657 | A | 7/1975 | Eckmayr |
| 3,930,486 | A | 1/1976 | Kahelin |
| 3,978,841 | A | 9/1976 | Yarur et al. |
| 3,990,426 | A | 11/1976 | Stokes |
| 4,021,036 | A | 5/1977 | Nelson et al. |
| 4,027,646 | A | 6/1977 | Sweeton |
| 4,034,644 | A | 7/1977 | Hupp et al. |
| 4,044,290 | A | 8/1977 | Gullo |
| 4,073,280 | A | 2/1978 | Koehn et al. |
| 4,112,911 | A | 9/1978 | Petrick, Sr. |
| 4,116,192 | A | 9/1978 | Scott |
| 4,148,415 | A | 4/1979 | Florida et al. |
| 4,185,824 | A | 1/1980 | Natwick |
| 4,207,857 | A | 6/1980 | Balka, Jr. |
| 4,280,697 | A | 7/1981 | Yuasa |
| 4,299,383 | A | 11/1981 | Yuasa |
| 4,332,097 | A | 6/1982 | Taylor, Jr. |
| 4,391,264 | A | 7/1983 | Abraham et al. |
| 4,396,193 | A | 8/1983 | Reinhardt et al. |
| 4,481,862 | A | 11/1984 | Wiethoff et al. |
| 4,487,103 | A | 12/1984 | Atchisson |
| 4,502,455 | A | 3/1985 | Stokes |
| 4,563,999 | A | 1/1986 | Miehlich |
| 4,646,709 | A | 3/1987 | Kholin |
| 4,676,137 | A | 6/1987 | Stockton et al. |
| 4,695,954 | A | 9/1987 | Rose et al. |
| 4,745,842 | A | 5/1988 | Shou-Fu |
| 4,748,600 | A | 5/1988 | Urquhart |
| 4,759,435 | A | 7/1988 | Cedrone |
| 4,765,223 | A | 8/1988 | Beckmann |
| 4,770,153 | A | 9/1988 | Edelman |
| 4,817,955 | A | 4/1989 | Hickson et al. |
| 4,819,609 | A | 4/1989 | Tippmann |
| 4,834,060 | A | 5/1989 | Greene |
| 4,850,330 | A | 7/1989 | Nagayoshi |
| 4,896,646 | A | 1/1990 | Kahelin et al. |
| 4,923,066 | A | 5/1990 | Ophir et al. |
| 4,926,742 | A | 5/1990 | Ma et al. |
| 4,930,400 | A | 6/1990 | Brandl et al. |
| 4,936,282 | A | 6/1990 | Dobbins et al. |
| 4,951,548 | A | 8/1990 | Wixon et al. |
| 4,951,644 | A | 8/1990 | Bon |
| 4,965,951 | A | 10/1990 | Miller et al. |
| 4,986,251 | A | 1/1991 | Lilley |
| 4,993,400 | A | 2/1991 | Fitzwater |
| 5,042,685 | A | 8/1991 | Moulding, Jr. et al. |
| 5,061,222 | A | 10/1991 | Suris |
| 5,063,905 | A | 11/1991 | Farrell |
| 5,070,995 | A | 12/1991 | Schaffer et al. |
| 5,097,816 | A | 3/1992 | Miller |
| 5,097,985 | A | 3/1992 | Jones |
| 5,166,457 | A | 11/1992 | Lorenzetti |
| 5,233,125 | A | 8/1993 | Bouver et al. |
| 5,251,906 | A | 10/1993 | Heller et al. |
| 5,282,454 | A | 2/1994 | Bell et al. |
| 5,322,283 | A | 6/1994 | Ritchie et al. |
| 5,335,579 | A | 8/1994 | David |
| 5,337,726 | A | 8/1994 | Wood |
| 5,353,712 | A | 10/1994 | Olson |
| 5,361,746 | A | 11/1994 | Szente |
| 5,383,442 | A | 1/1995 | Tippmann |
| 5,456,153 | A | 10/1995 | Bentley et al. |
| 5,464,208 | A | 11/1995 | Pierce |
| 5,490,493 | A | 2/1996 | Salansky |
| 5,497,758 | A | 3/1996 | Dobbins et al. |
| 5,505,188 | A | 4/1996 | Williams |
| 5,507,271 | A | 4/1996 | Actor |
| 5,511,333 | A | 4/1996 | Farrell |
| 5,520,171 | A | 5/1996 | David |
| 5,542,570 | A | 8/1996 | Nottingham et al. |
| 5,555,662 | A | 9/1996 | Teetzel |
| 5,561,258 | A | 10/1996 | Bentley et al. |
| 5,600,083 | A | 2/1997 | Bentley et al. |
| 5,673,812 | A | 10/1997 | Nelson |
| 5,675,110 | A | 10/1997 | Gyre et al. |
| 5,722,383 | A | 3/1998 | Tippmann, Sr. et al. |
| 5,727,538 | A | 3/1998 | Ellis |
| 5,736,720 | A | 4/1998 | Bell et al. |
| 5,749,797 | A | 5/1998 | Sunseri et al. |
| 5,755,056 | A | 5/1998 | Danner et al. |
| 5,771,875 | A | 6/1998 | Sullivan |
| 5,784,985 | A | 7/1998 | Lodico et al. |
| 5,791,325 | A | 8/1998 | Anderson |
| 5,794,606 | A | 8/1998 | Deak |
| 5,809,983 | A | 9/1998 | Stoneking |
| 5,816,232 | A | 10/1998 | Bell |
| 5,819,715 | A | 10/1998 | Haneda et al. |
| 5,836,583 | A | 11/1998 | Towers |
| 5,839,422 | A | 11/1998 | Ferris |
| 5,881,962 | A | 3/1999 | Schmidt et al. |
| 5,887,578 | A | 3/1999 | Backeris et al. |
| 5,947,100 | A | 9/1999 | Anderson |
| 5,954,042 | A | 9/1999 | Harvey |
| 6,032,395 | A | 3/2000 | Bentley et al. |
| 6,055,975 | A | 5/2000 | Gallagher et al. |
| 6,062,208 | A | 5/2000 | Seefeldt et al. |
| 6,083,105 | A | 7/2000 | Ronin et al. |
| 6,085,735 | A | 7/2000 | Cheek, Jr. |
| 6,109,252 | A | 8/2000 | Stevens |
| 6,206,562 | B1 | 3/2001 | Eyraud et al. |
| 6,213,110 | B1 | 4/2001 | Christopher et al. |
| 6,220,237 | B1 | 4/2001 | Johnson et al. |
| 6,305,367 | B1 | 10/2001 | Kotsiopoulos et al. |
| 6,311,682 | B1 | 11/2001 | Rice et al. |
| 6,325,233 | B1 | 12/2001 | Harris |
| 6,327,953 | B1 | 12/2001 | Andresen |
| 6,347,621 | B1 | 2/2002 | Guthrie |
| 6,349,711 | B1 | 2/2002 | Perry et al. |
| 6,374,819 | B1 | 4/2002 | Ming-Hsien |
| 6,408,836 | B1 | 6/2002 | Ming-Hsien |
| 6,408,837 | B1 | 6/2002 | Johnson et al. |
| D459,767 | S | 7/2002 | Rushton |
| 6,415,781 | B1 | 7/2002 | Perrone |
| 6,418,919 | B1 | 7/2002 | Perrone |
| 6,425,781 | B1 | 7/2002 | Bernstein et al. |
| 6,460,530 | B1 | 10/2002 | Backeris et al. |
| 6,467,473 | B1 | 10/2002 | Kostiopoulos |

(56) References Cited

U.S. PATENT DOCUMENTS 6,468,879 B1 10/2002 Lamure et al.
6,481,432 B2 11/2002 Rushton et al.
6,488,019 B2 12/2002 Kotsiopoulos
6,502,567 B1 1/2003 Christopher et al.
6,520,854 B1 2/2003 McNally
6,526,955 B1 3/2003 Juan
6,588,412 B2 7/2003 Ferrara et al.
6,591,824 B2 7/2003 Hatcher
6,601,780 B1 8/2003 Sheng
6,609,511 B2 8/2003 Kotsiopoulos et al.
6,615,814 B1 9/2003 Rice et al.
6,644,293 B2 11/2003 Jong
6,644,295 B2 11/2003 Jones
6,644,296 B2 11/2003 Gardner, Jr.
6,666,203 B2 12/2003 Maeda et al.
6,684,873 B1 2/2004 Anderson et al.
6,701,907 B2 3/2004 Christopher et al.
6,701,909 B2 3/2004 Tiberius et al.
6,708,685 B2 3/2004 Masse
6,722,355 B1 4/2004 Andrews, Jr.
6,725,852 B1 4/2004 Yokota et al.
6,729,321 B2 5/2004 Ho
6,729,497 B2 5/2004 Rice et al.
6,739,322 B2 5/2004 Rice et al.
6,739,323 B2 5/2004 Tippmann, Jr.
6,742,512 B1 6/2004 Ho et al.
6,752,137 B2 6/2004 Brunette et al.
6,792,933 B2 9/2004 Christopher et al.
6,802,306 B1 10/2004 Rice
6,860,258 B2 3/2005 Farrell
6,889,680 B2 5/2005 Christopher et al.
6,899,328 B2 5/2005 Halliburton et al.
6,915,792 B1 7/2005 Sheng
6,925,997 B2 8/2005 Sheng
6,978,776 B2 12/2005 Hamilton
6,981,493 B1 1/2006 Poteracke
7,000,603 B1 2/2006 Steenbeke
7,017,569 B2 3/2006 Jong
7,021,302 B2 4/2006 Neumaster et al.
7,040,505 B2 5/2006 Hashimoto et al.
7,077,118 B2 7/2006 Lewis
D535,339 S 1/2007 Broersma
7,159,585 B2 1/2007 Quinn et al.
7,210,473 B2 5/2007 Jong
7,216,641 B2 5/2007 Friesen et al.
7,222,617 B2 5/2007 Andresen
D544,047 S 6/2007 Bell et al.
7,231,914 B2 6/2007 Hatcher
7,234,456 B2 6/2007 Andresen
7,237,545 B2 7/2007 Masse
7,270,120 B2 9/2007 Broersma et al.
7,270,121 B2 9/2007 Lubben
7,322,347 B2 1/2008 Broersma
7,322,348 B2 1/2008 Chen
7,343,909 B2 3/2008 Christopher et al.
D567,302 S 4/2008 Choi
D567,303 S 4/2008 Neumaster
7,357,129 B2 4/2008 Neumaster et al.
7,357,130 B2 4/2008 Broersma
D572,318 S 7/2008 Broersma
7,428,899 B2 9/2008 Andresen
7,441,556 B2 10/2008 Friesen et al.
7,445,002 B2 11/2008 Christopher et al.
7,458,370 B2 12/2008 Chen
D584,776 S 1/2009 Stevens
7,487,769 B2 2/2009 Lubben
7,490,597 B2 2/2009 Hatcher
7,527,049 B2 5/2009 Sheng
7,568,478 B2 8/2009 Hedberg
7,591,260 B1 9/2009 Mu
D602,537 S 10/2009 Stevens
D604,371 S 11/2009 Stevens
7,617,817 B1 11/2009 Kulp
7,624,726 B2 12/2009 Wood
7,654,255 B2 2/2010 Spicer
7,673,627 B2 3/2010 Higgins et al.
7,694,669 B2 4/2010 Campo
7,762,246 B2 7/2010 Telford
7,770,569 B2 8/2010 Andresen
7,770,571 B2 8/2010 Tippmann, Jr. et al.
7,779,825 B2 8/2010 Estrate
7,832,389 B2 11/2010 Christopher
7,841,328 B2 11/2010 Italia et al.
7,854,220 B1 12/2010 Neumaster
7,886,731 B2 2/2011 Masse
7,913,679 B2 3/2011 Quinn et al.
7,921,834 B2 4/2011 Hamilton
7,921,835 B2 4/2011 Campo et al.
7,966,999 B2 * 6/2011 Bosch et al. ..... 124/51.1
8,047,191 B2 11/2011 Christopher et al.
8,061,342 B2 11/2011 Christopher et al.
8,091,541 B2 1/2012 Andresen
8,100,119 B2 1/2012 Hall
8,104,462 B2 1/2012 Christopher et al.
8,191,543 B2 6/2012 Masse
8,210,159 B1 * 7/2012 Neumaster et al. ..... 124/51.1
8,235,031 B2 * 8/2012 Kim ..... 124/77
8,251,050 B2 8/2012 Christopher et al.
8,272,373 B2 9/2012 Masse
RE43,756 E 10/2012 Christopher et al.
8,333,181 B1 12/2012 Rice
8,336,532 B2 12/2012 Masse
8,356,589 B2 1/2013 Karnis
8,375,929 B2 2/2013 Andresen
8,381,710 B2 2/2013 Nguyen
8,387,607 B2 3/2013 Christopher et al.
8,413,644 B2 4/2013 Masse
8,448,631 B2 5/2013 Spicer et al.
8,561,600 B2 10/2013 Christopher et al.
8,739,770 B2 6/2014 Masse
8,950,387 B2 * 2/2015 Stevens ..... 124/73
2001/0029937 A1 10/2001 Hatcher
2001/0039945 A1 11/2001 Rushton et al.
2002/0014230 A1 2/2002 Christopher et al.
2002/0020402 A1 2/2002 Kotsiopoulos
2002/0059927 A1 5/2002 Woods, Sr.
2002/0059928 A1 5/2002 Ferrara et al.
2002/0092513 A1 7/2002 Christopher et al.
2002/0112713 A1 8/2002 Backeris et al.
2002/0117159 A1 8/2002 Kotsiopoulos et al.
2002/0170552 A1 11/2002 Gardner, Jr.
2002/0175465 A1 11/2002 Halliburton et al.
2003/0005918 A1 1/2003 Jones
2003/0010330 A1 1/2003 Jong
2003/0024520 A1 2/2003 Dobbins
2003/0047173 A1 3/2003 Juan
2003/0047174 A1 3/2003 Tiberius et al.
2003/0079731 A1 5/2003 Dobbins
2003/0121927 A1 7/2003 Rice et al.
2003/0127084 A1 7/2003 Tippmann, Jr.
2003/0127085 A1 7/2003 Brunette et al.
2003/0131835 A1 7/2003 Rice et al.
2003/0168052 A1 9/2003 Masse
2003/0168053 A1 9/2003 Farrell
2003/0188730 A1 10/2003 Maeda et al.
2004/0000300 A1 1/2004 Ho
2004/0074487 A1 4/2004 Christopher et al.
2004/0074489 A1 4/2004 Neumaster et al.
2004/0112356 A1 6/2004 Hatcher
2004/0134475 A1 7/2004 Jong
2004/0194772 A1 10/2004 Hamilton
2004/0211402 A1 10/2004 Christopher et al.
2004/0216728 A1 11/2004 Jong
2004/0245276 A1 12/2004 Hashimoto et al.
2005/0028801 A1 2/2005 Lewis
2005/0121015 A1 6/2005 Postorivo, Jr.
2005/0166904 A1 8/2005 Friesen et al.
2005/0188974 A1 9/2005 Pedicini et al.
2005/0188978 A1 9/2005 Tiberius et al.
2005/0217653 A1 10/2005 Christopher et al.
2005/0241628 A1 11/2005 Hatcher
2005/0274370 A1 12/2005 Lubben
2005/0274371 A1 12/2005 Lubben
2005/0284456 A1 12/2005 Chipley

(56) References Cited

U.S. PATENT DOCUMENTS

| | | | | |
|---|---|---|---|---|
| 2005/0284457 | A1 | 12/2005 | Hatcher | |
| 2006/0005822 | A1 | 1/2006 | Quinn et al. | |
| 2006/0005823 | A1 | 1/2006 | Quinn et al. | |
| 2006/0032488 | A1 | 2/2006 | Telford | |
| 2006/0037597 | A1 | 2/2006 | Wood | |
| 2006/0042614 | A1 | 3/2006 | Broersma | |
| 2006/0054151 | A1 | 3/2006 | Christopher et al. | |
| 2006/0081233 | A1 | 4/2006 | Andresen | |
| 2006/0081234 | A1 | 4/2006 | Andresen | |
| 2006/0086347 | A1 | 4/2006 | Hedberg | |
| 2006/0124118 | A1 | 6/2006 | Dobbins | |
| 2006/0130821 | A1 | 6/2006 | Hamilton | |
| 2006/0157040 | A1 | 7/2006 | Broersma et al. | |
| 2006/0157041 | A1 | 7/2006 | Friesen | |
| 2006/0196489 | A1 | 9/2006 | Campo | |
| 2006/0249131 | A1 | 11/2006 | Broersma | |
| 2006/0254572 | A1 | 11/2006 | Hall | |
| 2007/0012303 | A1 | 1/2007 | Christopher et al. | |
| 2007/0012304 | A1 | 1/2007 | van Dorsser et al. | |
| 2007/0017494 | A1 | 1/2007 | Andresen | |
| 2007/0017495 | A1 | 1/2007 | Andresen | |
| 2007/0023025 | A1 | 2/2007 | Neumaster et al. | |
| 2007/0056573 | A1 | 3/2007 | Campo | |
| 2007/0062506 | A1 | 3/2007 | Bell | |
| 2007/0101981 | A1 | 5/2007 | Chen | |
| 2007/0113834 | A1 | 5/2007 | Spicer | |
| 2007/0137631 | A1 | 6/2007 | Christopher | |
| 2007/0175463 | A1 | 8/2007 | Higgins et al. | |
| 2007/0181117 | A1 | 8/2007 | Tippmann, Jr. et al. | |
| 2007/0215137 | A1 | 9/2007 | Jones et al. | |
| 2007/0246479 | A1 | 10/2007 | Andresen | |
| 2007/0256676 | A1 | 11/2007 | Orvis et al. | |
| 2008/0017178 | A1 | 1/2008 | Marques et al. | |
| 2008/0047535 | A1 | 2/2008 | Handel | |
| 2008/0047536 | A1 | 2/2008 | Chen | |
| 2008/0047537 | A1 | 2/2008 | Kulp et al. | |
| 2008/0053422 | A1 | 3/2008 | Estrate | |
| 2008/0087264 | A1 | 4/2008 | Postorivo | |
| 2008/0141990 | A1 | 6/2008 | Andresen | |
| 2008/0178859 | A1 | 7/2008 | Moore et al. | |
| 2008/0216805 | A1 | 9/2008 | Christopher et al. | |
| 2008/0236558 | A1* | 10/2008 | Bosch et al. | 124/48 |
| 2009/0000608 | A1 | 1/2009 | Christopher et al. | |
| 2009/0025700 | A1 | 1/2009 | Andresen | |
| 2009/0056691 | A1 | 3/2009 | Christopher et al. | |
| 2009/0133680 | A1 | 5/2009 | Christopher et al. | |
| 2009/0178659 | A1 | 7/2009 | Spicer | |
| 2009/0241929 | A1 | 10/2009 | Italia et al. | |
| 2010/0258101 | A1 | 10/2010 | Campo et al. | |
| 2011/0067681 | A1 | 3/2011 | Stevens et al. | |
| 2011/0186025 | A1 | 8/2011 | Campo et al. | |
| 2011/0220086 | A1* | 9/2011 | Bosch et al. | 124/51.1 |
| 2012/0042862 | A1 | 2/2012 | Christopher et al. | |
| 2012/0125303 | A1 | 5/2012 | Christopher et al. | |
| 2012/0272940 | A1 | 11/2012 | Christopher et al. | |
| 2014/0209082 | A1* | 7/2014 | Stevens | 124/73 |

FOREIGN PATENT DOCUMENTS

| | | |
|---|---|---|
| DE | 2035097 | 1/1972 |
| DE | 3721527 | 1/1989 |
| DE | 4343870 | 6/1994 |
| DE | 4343871 | 6/1995 |
| DE | 19922589 | 12/2000 |
| EP | 0075970 | 4/1983 |
| EP | 1054228 | 11/2000 |
| EP | 1653189 | 5/2006 |
| FR | 921527 | 5/1947 |
| GB | 470201 | 8/1937 |
| GB | 551077 | 2/1943 |
| GB | 2322438 | 8/1998 |
| JP | 1179898 | 7/1989 |
| JP | 6-325233 | 11/1994 |
| TW | M255391 | 1/2005 |
| WO | 98/13660 | 4/1998 |
| WO | 01/44745 | 6/2001 |
| WO | 02/42708 | 5/2002 |
| WO | 03/087698 | 10/2003 |
| WO | 2007/033309 | 3/2007 |
| WO | 2007/035601 | 3/2007 |
| WO | 2007/044546 | 4/2007 |
| WO | 2007/044822 | 4/2007 |
| WO | 2007/098554 | 9/2007 |
| WO | 2008/104061 | 4/2008 |
| WO | 2009/009748 | 1/2009 |
| WO | 2009/015393 | 1/2009 |

OTHER PUBLICATIONS

Warpig—World And Regional Paintball Information Guide, http://www.warpig.com/paintball/technical/loaders/halo/review/shtml, warpig.com, Odyssey Halo by Bill Mills, Dec. 2001, pp. 1 to 7.

Odyssey Halo B Paintball Hopper Review, http://www.paintball-gun-review.com/hopper-reviews/odyssey-halo-b . . . , Paintball Gun Review, Odyssey Halo B Paintball Hopper Review, 2004 Paintball-Gun-Review.com, pp. 1 to 3.

www.odysseypaintball.com, http://web.archive.org/web/20030205112543/http://www.odysseypain . . . , Odyssey Paintball Products, Understanding Halo B, pp. 1 to 3.

Warpig—World And Regional Paintball Information Guide, http://www.warpig.com/paintball/technical/loaders/evlution/evlution . . . eVLution 2 Sneak Preview, by Bill Mills, Aug. 2001, p. 1 to 4.

Warpig—World And Regional Paintball Information Guide, http://www.warpig.com/paintball/technical/loaders/evlution/index.shtml Brass Eagle's eVLution Loader, by Bill Mills, Aug. 2000, pp. 1 to 7.

Warpig—World And Regional Paintball Information Guide, http://www.warpig.com/paintball/technical/labs/revytimes/index/shtml WARPIG Ballistic Labs Report: Revolution Response Times, by Bill Mills, copyright 1992-2010, pp. 1 to 4.

Warpig—World and Regional Paintball Information Guide http://www.warpig.com/paintball/technical/loaders/lineup WARPIG Ballistic Labs Loader Speed Comparison, by Bill Mills, Sep. 2001, 8 pages.

* cited by examiner

COMPRESSED GAS GUN HAVING BUILT-IN, INTERNAL PROJECTILE FEED MECHANISM

CROSS REFERENCE TO RELATED APPLICATION

This application claims the benefit of U.S. Provisional Patent Application No. 61/837,984, filed Jun. 21, 2013 and U.S. Provisional Patent Application No. 61/891,781, filed Oct. 16, 2013, the entire contents of which are hereby incorporated by reference as if fully set forth herein.

FIELD OF INVENTION

This invention relates to compressed gas guns, and more particularly, to a compressed gas gun having a built-in, internal projectile feed mechanism for feeding projectiles, such as paintballs, into a compressed gas gun such as a paintball marker.

BACKGROUND

A popular game/sport has developed over the years, which uses paintball guns or "markers." Players use the paintball guns to shoot projectiles known as paintballs. These paintballs are generally spherical capsules having a gelatin or starch based shell filled with paint or non-toxic dye. During play of the game, the players on each team advance towards each other. A player is eliminated from the game when the player is hit by a paintball fired from an opposing player's gun. When the paintball hits a player, a "splat" of paint is left on the player.

Some examples of paintball compressed gas guns, also called "markers" or "guns" (referred to herein as either compressed gas guns, markers or guns), are those offered under the brand names EMPIRE™, MINI™, AXE™, TM™, and BT™, and others shown and described in U.S. Pat. Nos. 8,336,532; 8,176,908; 7,921,837; 6,035,843; 7,946,285; 4,936,282; and 5,497,758, the entire contents of all of which are all incorporated by reference as if fully set forth herein.

Players use the paintball guns to shoot projectiles known as paintballs (projectiles and paintballs are used interchangeably herein). These paintballs are spherical, frangible projectiles normally having gelatin or starch-based shells filled with paint (coloring or dye). The shells break when impacting a target, allowing the paint within to splatter on the target. The sport of paintball is often played like capture the flag. A player is eliminated from the game when the player is hit by a paintball fired from an opposing player's marker. When the paintball hits a target such as a player, a mark or "splat" of paint is left on the player.

Paintball loaders (otherwise known as hoppers or magazines, and also referred to herein as "loaders") sit atop the markers and feed projectiles into the marker. These projectile loaders (the terms "feed mechanisms," "hopper," "magazine," and "loader" are used interchangeably herein) store projectiles, and have an outlet or exit tube (out feed tube or neck). The outlet tube is connected to an inlet tube (or feed neck) of a paintball marker, which is in communication with the breech of the paintball marker. Thus, the loaders act to hold and feed paintball projectiles into the breech of a paintball marker, so that the projectiles can be fired from the marker.

Many loaders contain agitators or feed systems to feed, move, mix, propel, or otherwise move projectiles in the loader. This mixing is performed by feeder, impeller, projection, carrier, drive cone, agitator, paddle, arm, fin, or any other mechanism, such as those shown and described in U.S. Pat. Nos. 6,213,110; 6,502,567; 5,947,100; 5,791,325; 5,954,042; 6,109,252; 6,889,680; and 6,792,933, the entire contents of all of which are incorporated by reference as if fully set forth herein. Because it is desirable to eliminate as many opposing players as possible, paintball markers are capable of semi-automatic rapid fire. The paintball loaders act to hold a quantity of projectiles, and ensure proper feeding of the projectiles to the marker for firing.

Paintball guns generally have two basic mechanisms working in conjunction for firing a paintball from the marker during a firing operation. One of these mechanisms is for loading a paintball in the breech of a paintball marker, and usually involves a bolt that reciprocates from a loading position, allowing a projectile into the breech, to a firing position. A valving system is employed to release compressed gas from a source of compressed gas to fire the projectile from the marker.

Referring to FIG. 1, an exemplary compressed gas gun 130 known in the art is illustrated having a gun body 132 with a rearward end 134 towards its grip 136 and a forward end 138 towards its barrel 140 is shown. The gun body 132 includes a generally cylindrical interior passage or space 133 (a portion of which may be considered a breech area) for receiving at least some of the firing components (e.g., the hammer and valving components) of the gun 130. A hammer 144 (sometimes referred to in the art as a ram, striker, or bolt) is disposed within the gun body 132 adjacent the rearward end 134 of the gun body 132, the hammer 144 having a forward end 146 facing the valve 160. The forward end 146 of the hammer 144 is adapted to contact a valve pin 148.

A main hammer spring 150 is disposed within the gun body 132 and biases the hammer 144 toward the forward or firing position. The hammer 144 is retained in a cocked or ready position by a sear 152 that pivots to engage a portion of the hammer 144. Actuation of a trigger 154 (such as by pulling the trigger) disengages the sear 152 from the hammer 144, allowing the hammer 144 to spring forward under the bias of the main hammer spring 150.

A bolt 156 is disposed within the gun body 132. A firing tube 158 is partially disposed within the bolt 156, such that the bolt 156 coaxially surrounds the firing tube 158. Forward movement of the bolt 156 causes forward movement and loading of a projectile 142.

A valve 160 is disposed within the gun body 132 between the hammer 144 and the bolt 156. The valve 160 includes a valve pin 148 extending rearward toward the hammer 144, the valve pin 148 including a contact end 162. A connecting rod 164 connects the hammer 144 and the bolt 156 for synchronized movement of the hammer 144 and the bolt 156. A connecting rod 164 provides a mechanical linkage between the hammer 144 and the bolt 156. The valve 160 assembly includes a valve housing 166 and a valve body 168 disposed within the valve housing 166. The valve body 168 includes an inlet port 170 for receiving gas under pressure from a gas line 196. The valve body 168 includes an outlet port 176 for communicating gas under pressure from within the valve body 168 when the valve 160 is actuated or open. A valve poppet 184 is disposed within the valve body 168. A sealing member such as a cup seal 186 is provided to the valve poppet 184.

FIG. 2 shows a side view of an exemplary paintball loader 400 operatively attached to a representative paintball gun 410 illustrated in phantom. The paintball gun includes a main body 412, a compressed gas cylinder 414, a front handgrip 416 or foregrip, a barrel 418, and a rear handgrip 419. The paintball gun also includes an infeed tube 420 leading to a firing chamber in the interior of the main body and a trigger 422. The front handgrip projects downwardly from the barrel and provides an area for gripping by an operator of the paintball gun. The compressed gas cylinder is typically secured to a rear portion of the paintball gun. The compressed gas cylinder normally contains CO2, or NO2, although any compressible gas may be used.

The paintball loader 400 includes a container body 430, screen, readout, or display 424, and may include a circuit board that which includes a microprocessor 426 for controlling the operation of the paintball loader, a motor 428, and an outfeed tube 432 that connects to the infeed tube 420 of the paintball gun.

Some of paintball guns operate using a pressure balanced poppet valves, such as the MINI™, TM-7™, TM-15™, and AXE™ series of paintball guns, as well as those disclosed in U.S. Pat. Nos. 6,601,780 and 6,925,997, the entire contents of which are incorporated herein by reference. FIG. 3 shows a known paintball marker (gun) having a pressure balanced poppet valve system, as in the MINI™ paintball marker, and FIG. 4 shows an exploded of such a paintball marker.

The paintball gun 900 of FIGS. 3, 4 include a trigger assembly 901 and a firing assembly 903. The trigger assembly 901 is used to actuate the firing of projectiles (e.g., paintballs) under the force of compressed gas from a source of compressed gas.

The firing assembly 903 is installed within the body 905 and is used to discharge the projectiles. The firing assembly 903 includes a housing 906 having a cylindrical channel 907, a valving system including poppet 908, and a bolt 913.

The poppet 908 is disposed within the housing 906 with a slimmer front part 909 and a wider rear part 910. The poppet 908 divides by the housing 906 into front air chamber 911 and a rear air chamber 912 with different pressure areas. A small through hole 923 is provided in the poppet 908 between the front and the rear air chambers.

The bolt 913 is placed around a bolt guide 914 toward the forward end 915 of the housing 906. A bolt spring 916 is disposed around the front part 917 of the bolt 913, biasing the bolt 913 to a rearward, open or ready to fire position.

A solenoid 918 including a moveable plunger 919 are used to control the opening or closing of an air flow channel 920, thereby leading to a pressure difference between the front air chamber 911 and rear air chamber 912 adjacent the poppet 908. As a result, the poppet 908 is shifted rearward, and some of the air flow is fed into a minor air channel to shift the bolt 913 forward under the force of compressed gas, overcoming the bias of the spring 916. Thereafter, the paintball 142 is discharged by the force of compressed gas entering the major air channel through the bolt.

A coupling or feed neck 924 is provided at the top portion of the body of the paintball gun 900. This feed neck 924 may be provided as a clamp or locking collet of some type, in order to mechanically attach a paintball loader having an outfeed tube to the feed neck 924.

As can be appreciated, one problem with many known paintball loaders or hoppers is that the paintball hoppers sit on top of the paintball marker when mounted for play. This positioning provides a target to opposing paintball sport players. This positioning also provides an obstruction to a player's view. It would be advantageous to have a paintball hopper positioned so that it both avoids providing a target for opposing players, but is also out of a player's line of sight.

While some paintball loaders or hoppers have been mounted below the breech area of paintball markers, these "box"-type loaders are bulky, and are positioned in front of the trigger or grip portions of the paintball markers, below the breech area. These paintball loaders must feed upwards into the breech area, against gravity. Often, a paintball marker must be customized or reconfigured to fit such paintball loaders. Also, these paintball loaders sit toward the front of the paintball marker. Accordingly, it would be advantageous to have a paintball loader that is not mounted on top of a paintball marker, where no special reconfiguration is required to attach the paintball loader to the paintball marker.

In addition, paintball markers and paintball loaders or hoppers are separate items that must be mechanically joined by, for example, an adaptor, clamp or collet of some type. This adapter provides a stress point, and can come uncoupled during game play. Accordingly, it would be advantageous to have a paintball marker and paintball hopper contained in a single, unitary body.

In addition, paintball markers and paintball hoppers have separate, non-communicating electronics and/or control units. That is, the paintball marker has its own control circuitry or electronics operating independently, and the paintball loader has its own control circuitry or electronics operating independently. It would be advantageous to have a single set of electronics and/or control circuitry and/or control unit that controls, monitors, synchronizes, integrates and/or operates both the paintball marker and the paintball hopper.

In addition, paintball markers and paintball loaders may be difficult to "field strip," that is, disassemble for cleaning, adjustment or any types of maintenance, particularly during paintball sport play, and without tools. It would be advantageous to have both a paintball marker and an integrated paintball loader that is easy to field strip, without the use of tools.

Finally, it would be advantageous to have a compressed gas gun, utilizing any type of firing assembly, and including an internal, built-in projectile loader.

The entire contents of following patents are incorporated by reference as if fully set forth herein: U.S. Pat. Nos. 8,336,532; 8,176,908; 7,921,837; 6,035,843; 7,946,285; 4,936,282; 5,497,758; 6,213,110; 6,502,567; 5,947,100; 5,791,325; 5,954,042; 6,109,252; 6,889,680; and 6,792,933.

SUMMARY OF THE INVENTION

A compressed gas gun is provided comprising a body housing both the firing assembly of the gun and an internal projectile feed ("loader") mechanism. The projectile feed mechanism is preferably housed completely internally within the body of the compressed gas gun loader.

The projectile feed mechanism preferably includes a feed tube having a portion having a generally "S"-shaped cross-section. The projectile feed mechanism may be positioned at a horizontal point lower than the firing assembly of the compressed gas gun.

Another feature of the compressed gas gun having a built-in internal loader of the present invention is tool-less "field stripping," or removal of certain components completely from the interior of the body of the compressed gas gun, without the need for tools.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF THE PREFERRED EMBODIMENTS

Figure 1:
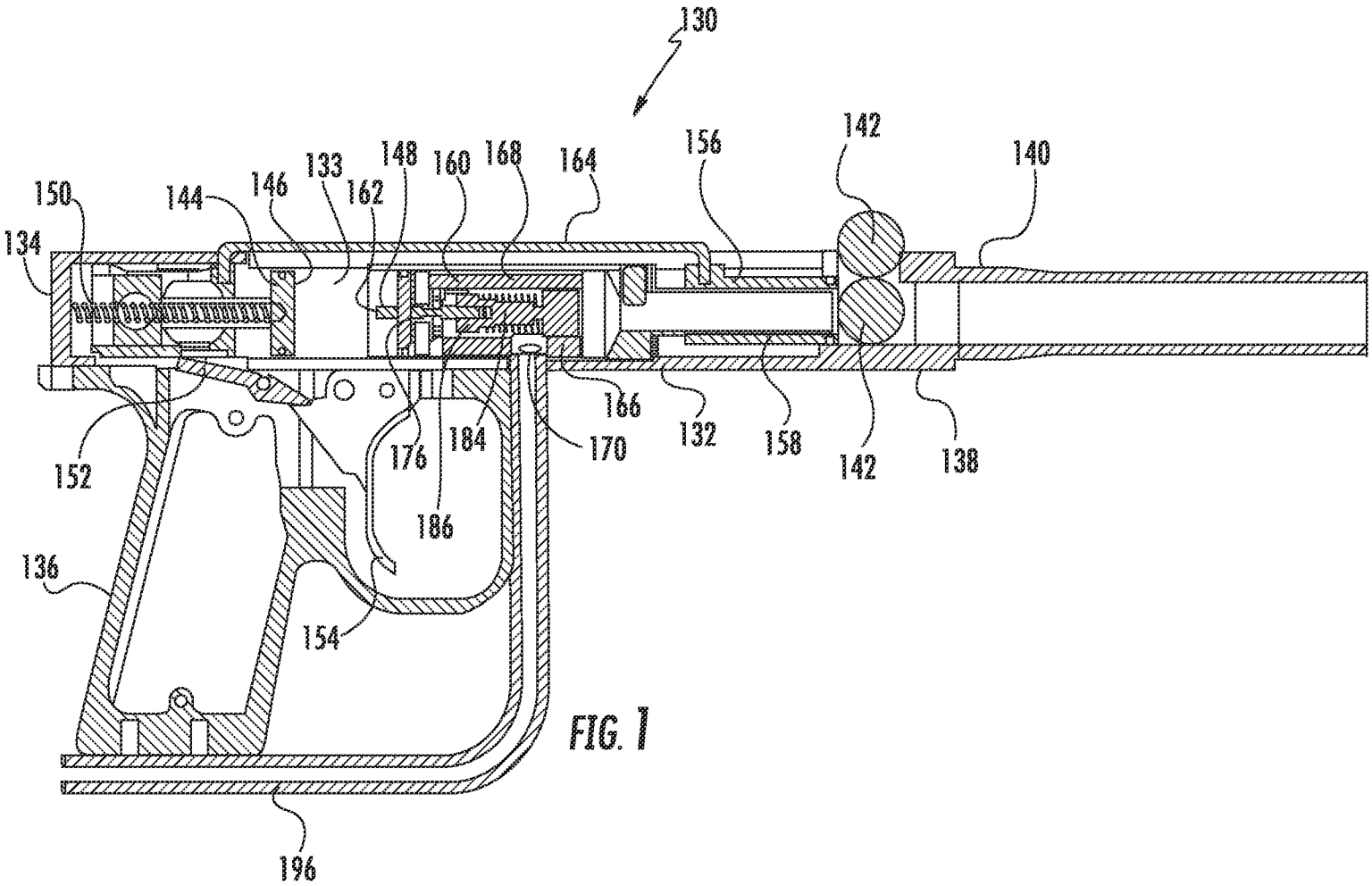
FIG. 1 shows a cross-sectional view of an exemplary compressed gas gun including a firing assembly.
Figure 2:
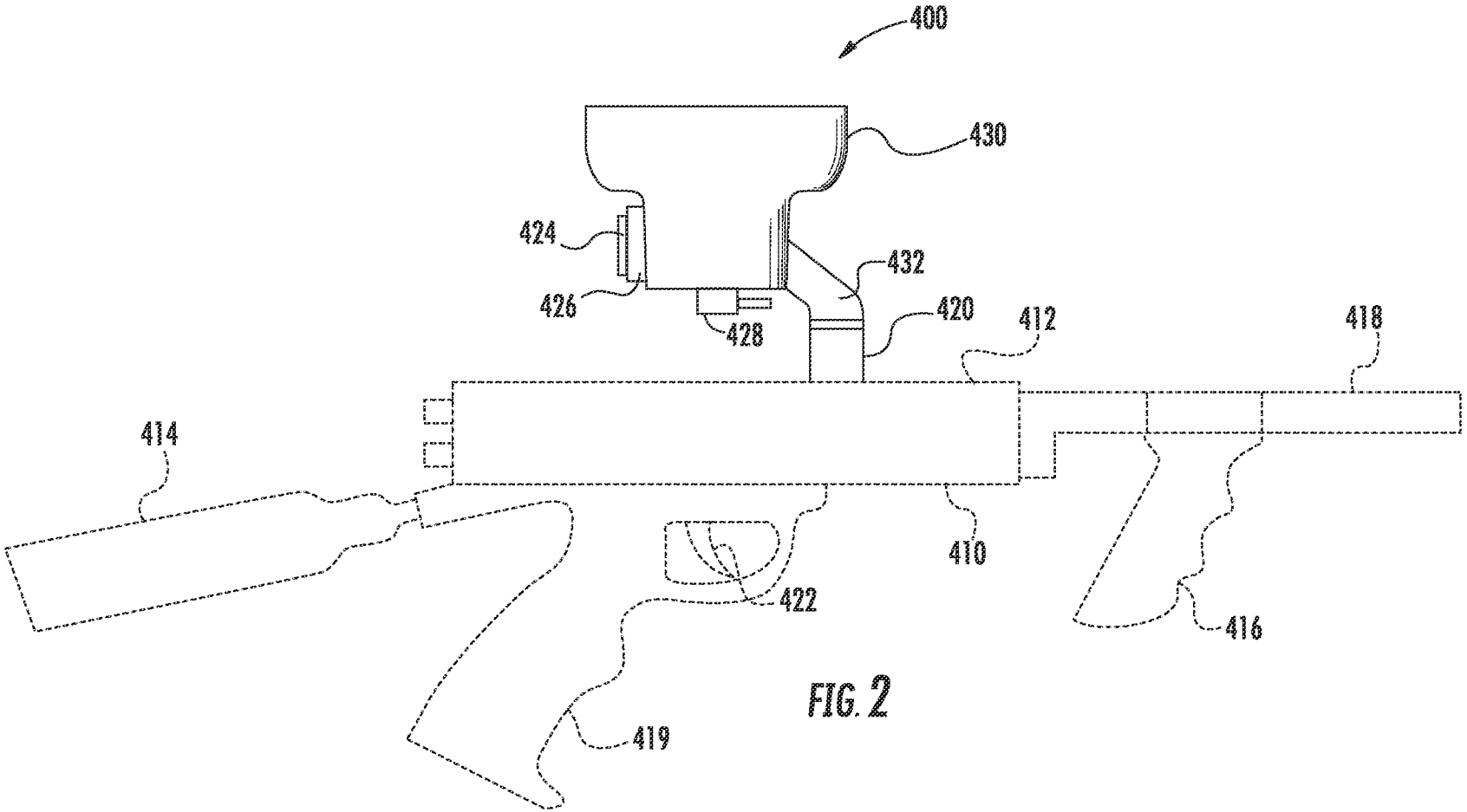
FIG. 2 shows a side view of an exemplary paintball loader operatively attached to a compressed gas gun.
Figure 3:
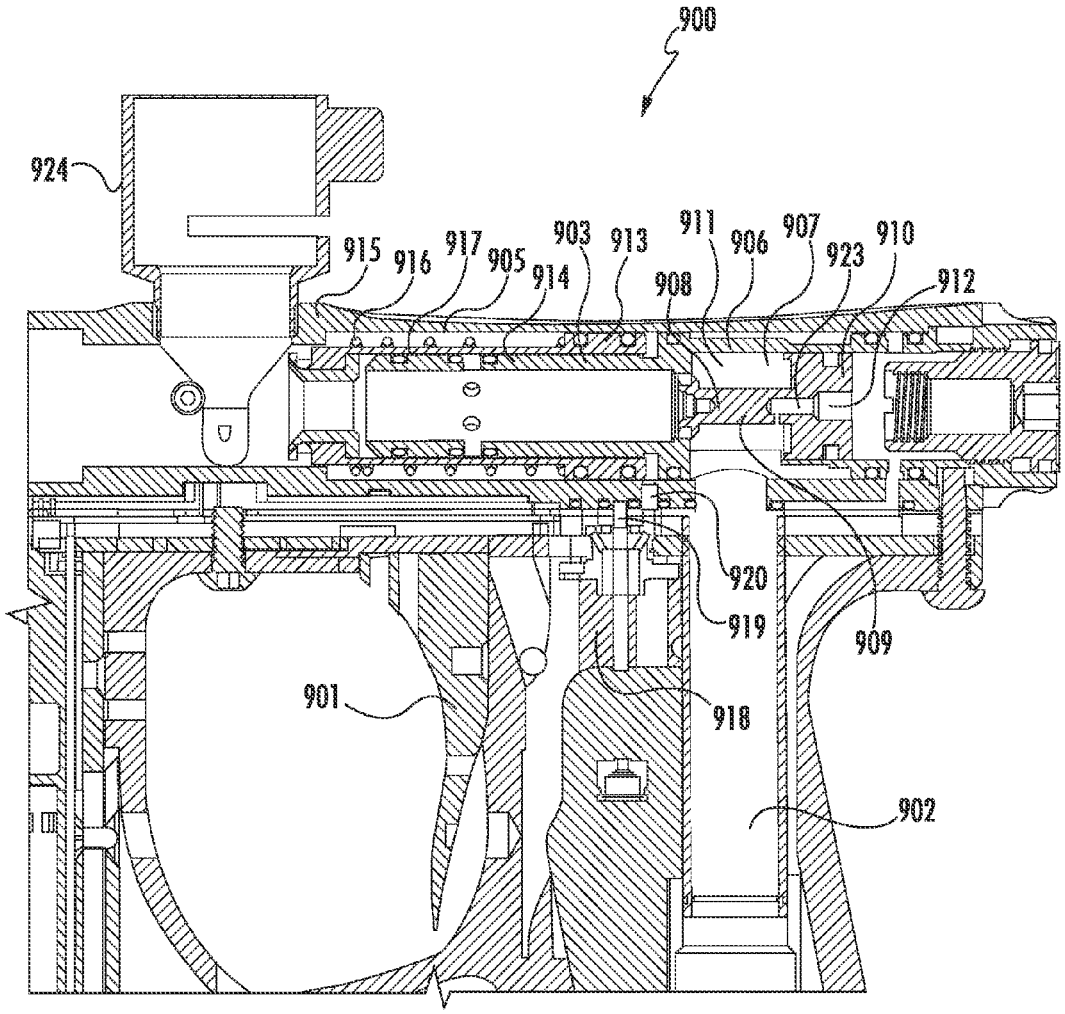
FIG. 3 shows a partial cross-sectional view of the internals of another exemplary compressed gas gun and firing assembly.
Figure 4:
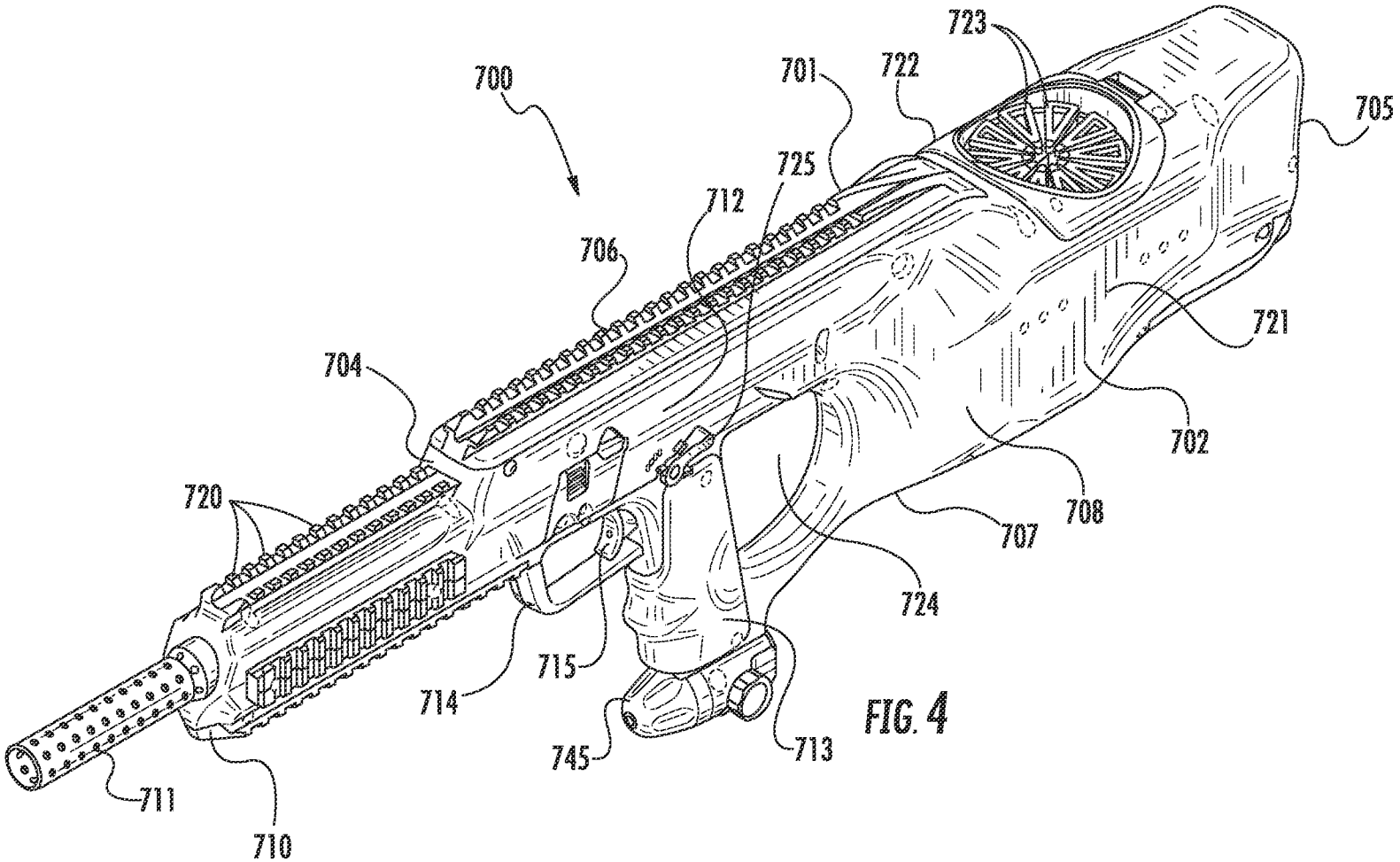
FIG. 4 a left side, top, front perspective view of an exemplary a compressed gas gun according to the present invention.
Figure 5:
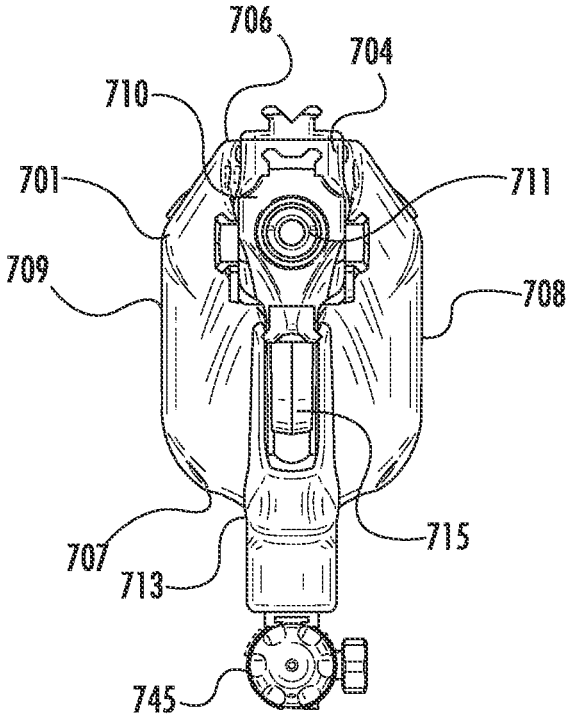
FIG. 5 shows a front view of an exemplary a compressed gas gun according to the present invention.
Figure 6:
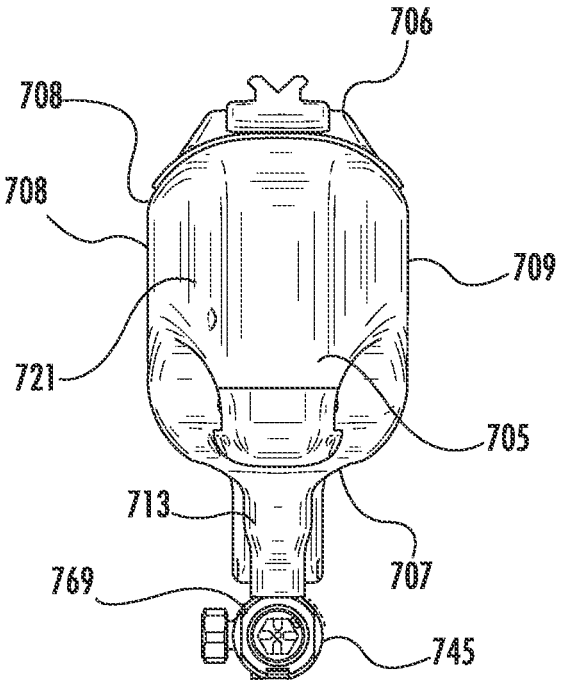
FIG. 6 shows a rear view of an exemplary a compressed gas gun according to the present invention.

A compressed gas gun 700 is provided, the exterior of which is shown in FIGS. 4-10, having an internal, built-in projectile feed mechanism, and preferably includes a gun body 701 having a front portion 704, rear portion 705, top (or "upper") portion 706, bottom (or "lower") portion 707, left side portion 708 and right side portion 709. The gun body 701 includes an exterior 702 and an interior 703.

A barrel portion 710, including a barrel 711, is provided adjacent the front portion 704. Various rails 720, such as "picatinny"-type rails are provided for attaching items (such as flashlights, sights, tools, etc.) to the gun body 701.

The gun body 701 includes a grip portion 713. A trigger guard 714 is provided, including a trigger 715 for firing the gun. The gun body 701 includes an opening 724 where a user's hand can fit, located between the grip portion 713 and the rear or projectile feed mechanism portion 721 of the gun body. The trigger 715 may actuate an electric switch 778 to initiate a firing operation. A firing assembly portion 712 is provided above the grip portion 713.

The rear portion 705 of the gun body 701 contains the built-in projectile feed mechanism portion 721 and includes an internal projectile feed mechanism 747, described in greater detail herein. Whereas known compressed gas guns and paintball loaders are separate and distinct, and must be connected such as by a feed adapter or other mechanism for use, the gun body of the present invention comprises a unitary housing with the projectile feed mechanism built into the gun body. This eliminates the need for a separate paintball loader, hopper or magazine. The projectile feed mechanism portion 721 effectively comprises a rear or "butt" stock of the compressed gas gun. Included at a top of the paintball loader portion is an opening that is selectively closed/opened by a lid 722. The lid 722 may be hingedly attached to the gun body by a hinge 763. In addition, a "quick feed" or "speed feed" type of lid may be employed, including flexible fingers 723 that allow a paintball loader pod to load paintballs into the opening, without opening the lid. An exemplary quick-feed lid-type system is shown and described in U.S. Pat. No. 6,234,157, the entire contents of which are incorporated herein by reference as if fully set forth herein. The quick-feed lid-type system allows a user to dump or load a container of paintballs into the reservoir of a paintball hopper, by forcing apart the flexible fingers 723, and thus, there is no need to open the lid to load paintballs. The flexible fingers 723 act as a one-way check valve system.

Figure 7:
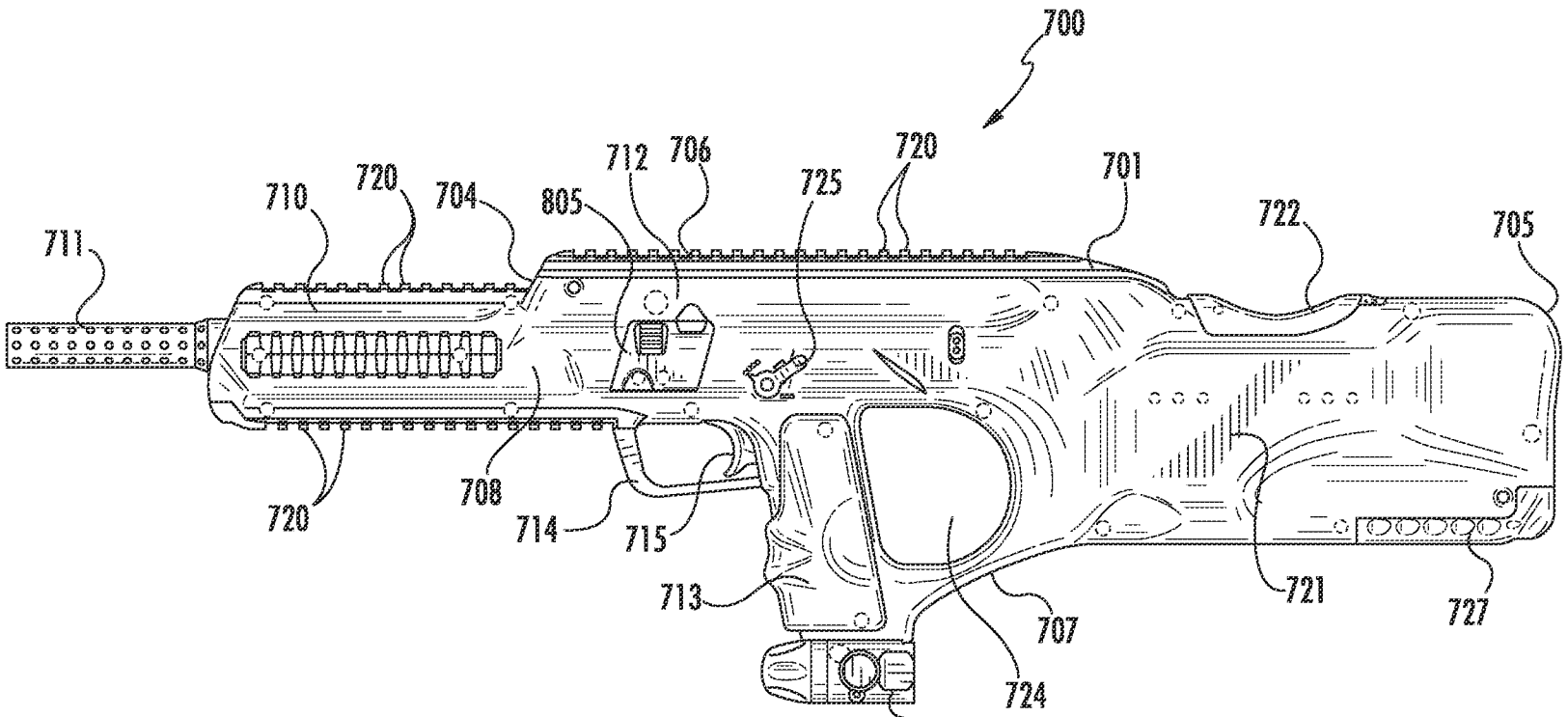
FIG. 7 shows a left side view of an exemplary a compressed gas gun according to the present invention.
Figure 8:
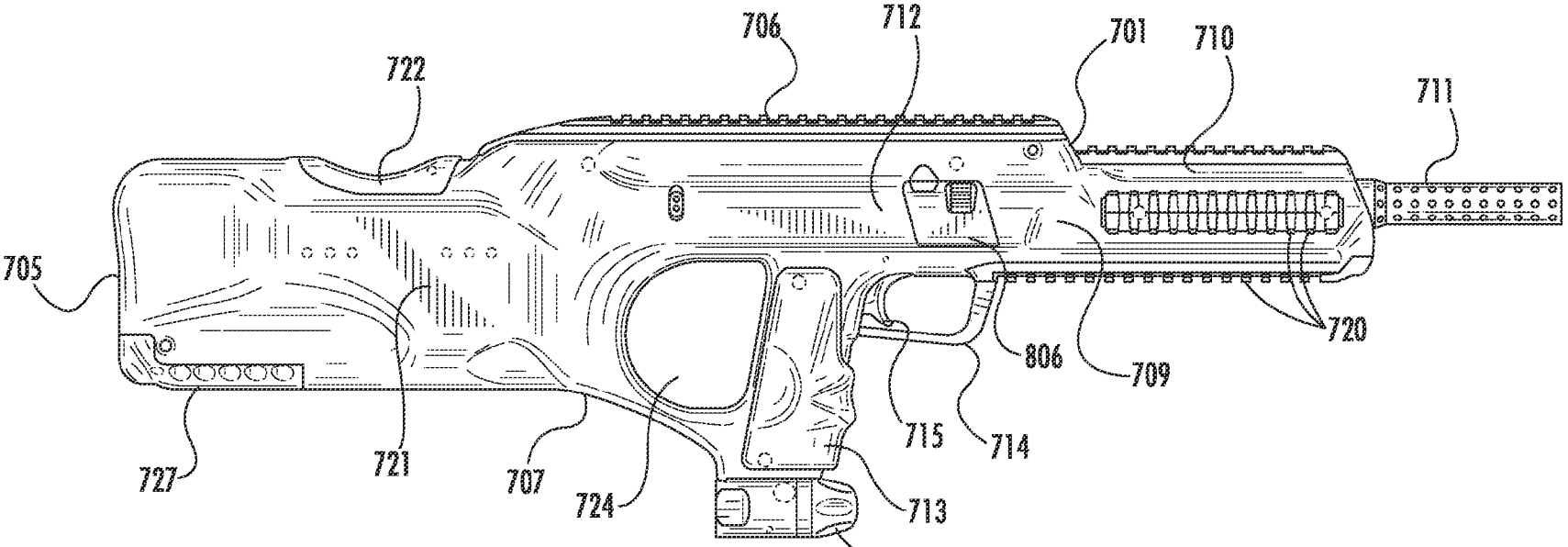
FIG. 8 shows a right side view of an exemplary a compressed gas gun according to the present invention.
Figure 9:
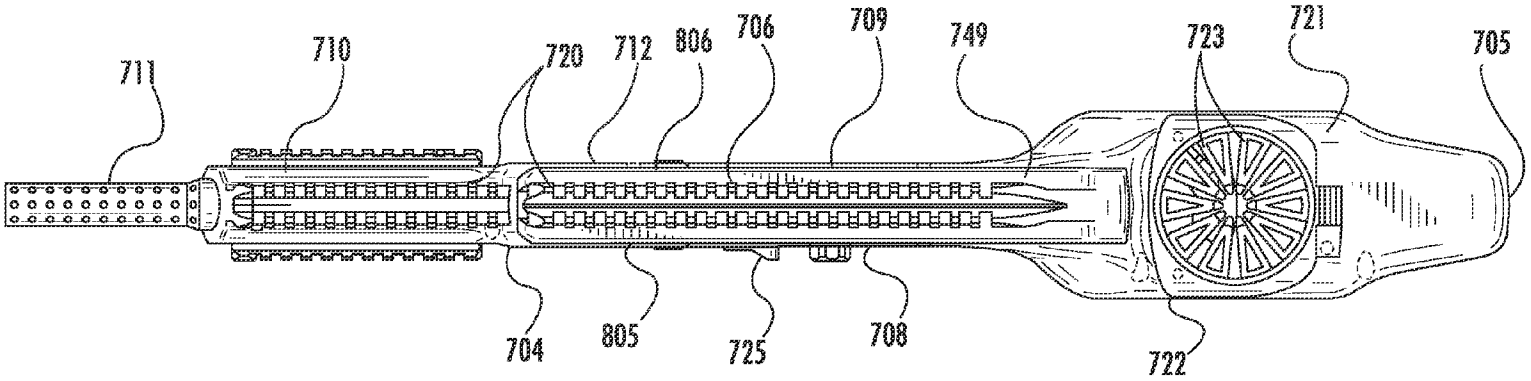
FIG. 9 shows a top view of an exemplary a compressed gas gun according to the present invention.
Figure 10:
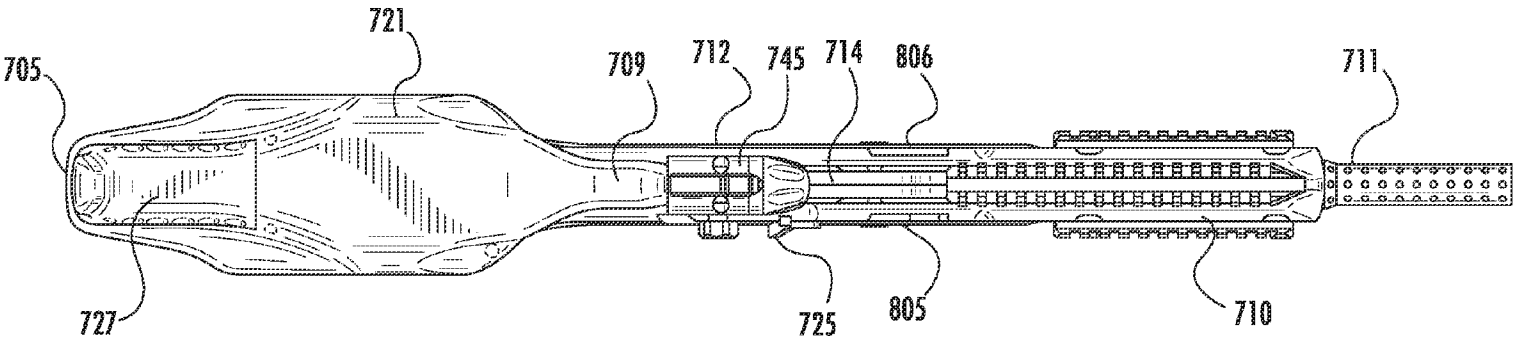
FIG. 10 shows a bottom view of an exemplary a compressed gas gun according to the present invention.
Figure 11:
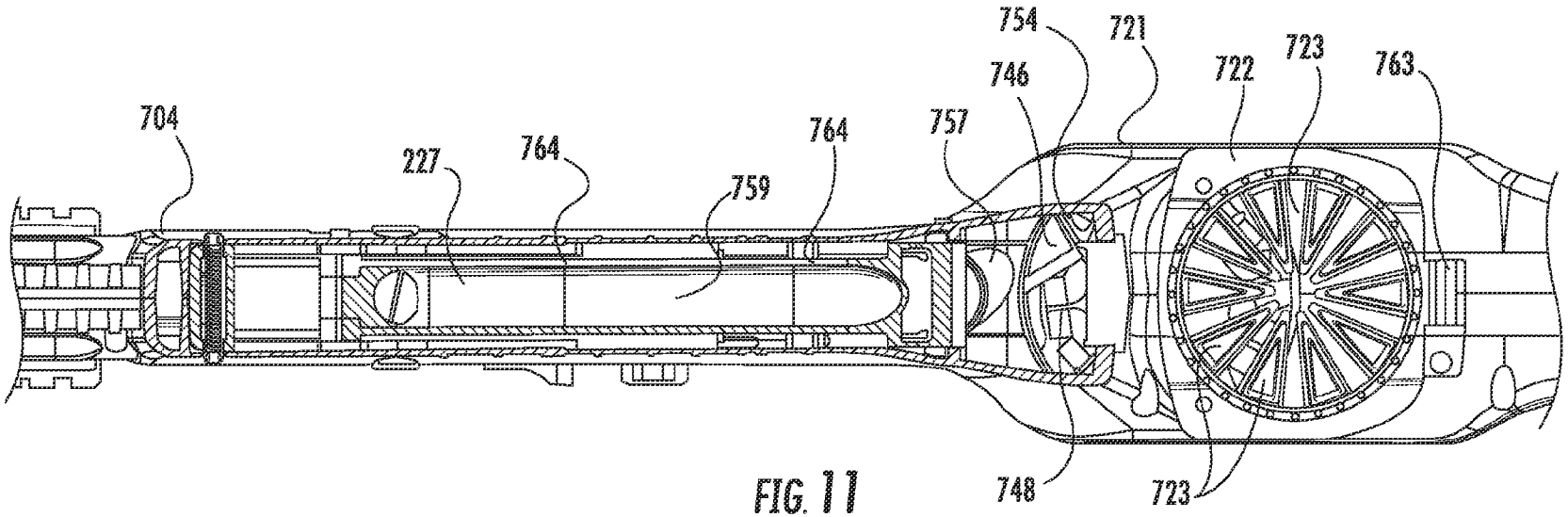
FIG. 11 shows a top view of an exemplary a compressed gas gun according to the present invention with the top rail assembly removed.
Figure 12:
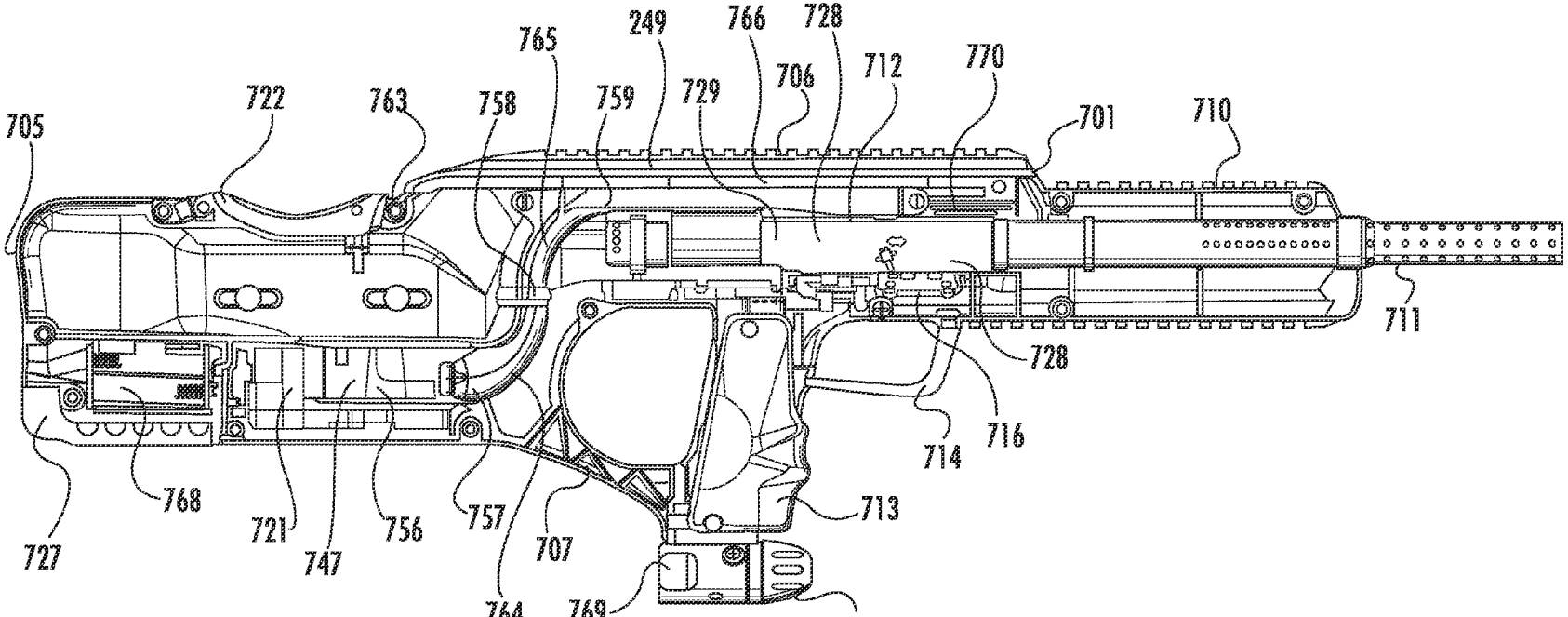
FIG. 12 shows a right side view of an exemplary a compressed gas gun according to the present invention with the right portion of the body shell removed to expose the internals of the compressed gas gun.
Figure 13:
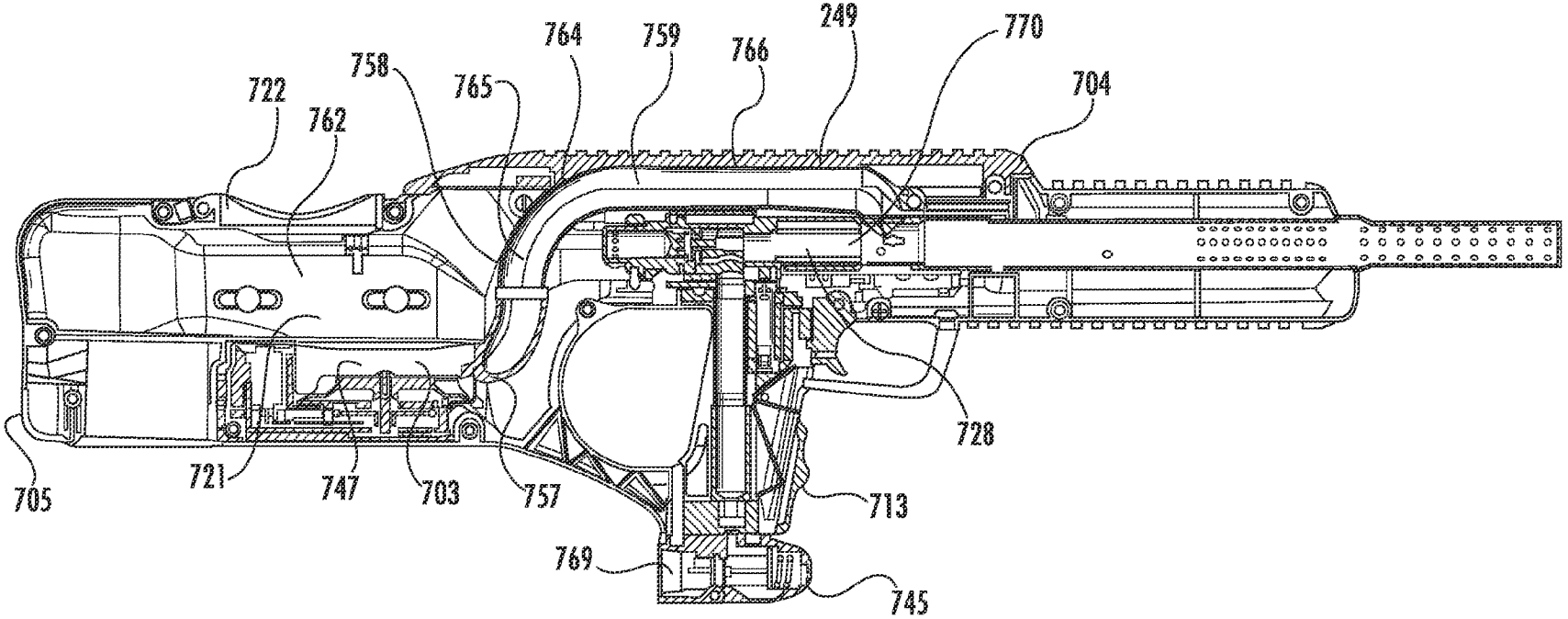
FIG. 13 shows a right side cross sectional view of an exemplary a compressed gas gun according to the present invention.
Figure 14:
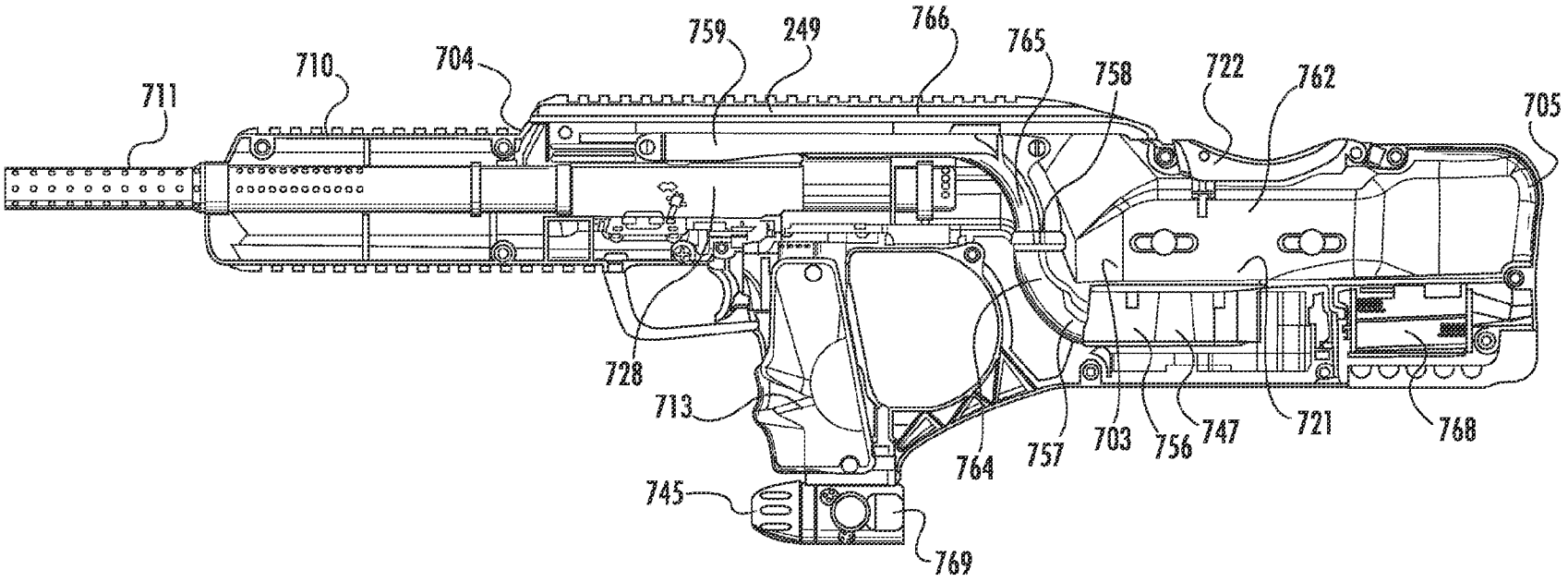
FIG. 14 shows a left side view of an exemplary a compressed gas gun according to the present invention with the left portion of the body shell removed to expose the internals of the compressed gas gun.
Figure 15:
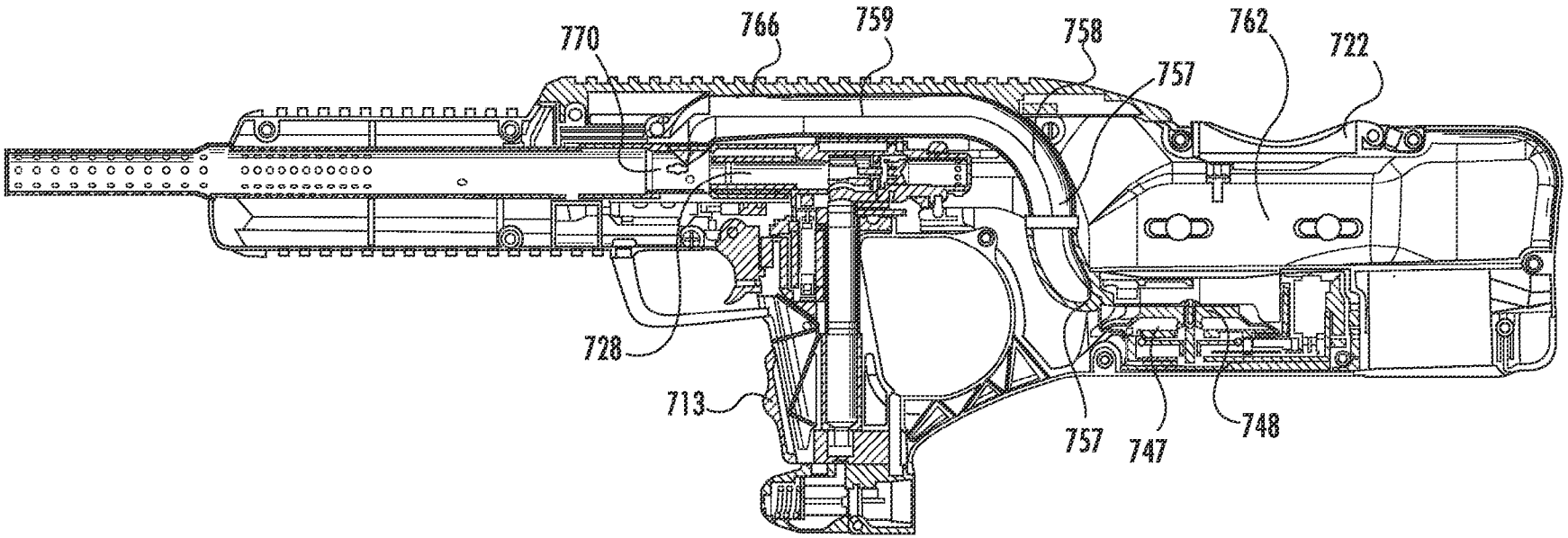
FIG. 15 shows a left side cross sectional view of an exemplary a compressed gas gun according to the present invention.

As shown in FIGS. 7, 8 and 10, the compressed gas gun body 701 may further include a battery door 727 that may slide or hingedly open for access to a power source 753 such as batteries, and including a battery holder 768. The power source is connected to a switch to power the electronics of the compressed gas gun ON/OFF. A regulator 745 of regulating and/or otherwise adjusting the gas pressure from an attached compressed gas tank may be provided adjacent the grip portion 713. A coupling 769 for attaching a compressed gas tank to the compressed gas gun is provided adjacent the grip portion 713. The coupling 769 is generally threaded and configured to accept the threaded portion of a compressed gas tank, as is well known in the art. The coupling may be in the form of a "bottom line" 719 portion as is known in the art.

As shown in FIGS. 7 and 8, the compressed gas gun body may further include one or more breech covers 805, 806 covering side breech openings 929 allowing access to the interior 930 of the firing assembly portion 712 of the gun body, such as for service. The breech covers 805, 806 are preferably located on opposite sides of the compressed gas gun body 701, adjacent a breech area 770. A mode selector switch 725 may be provided for selecting between various firing modes (single short, burst, automatic, semi-automatic) in communication with control circuitry of the compressed gas gun. The selector switch that 725 is user-actuable and may include one or more firing modes—Semi, Burst, Ramping, Full Auto and Select Fire. The firing mode selection electronics may also be in communication with and controlled by the control circuitry.

An exemplary firing assembly 728 (or "firing mechanism") that may be used is a pressure balanced poppet valve system similar to those in the MINI™, AXE™, or TM™ compressed gas guns, and examples of which are shown in greater detail in FIGS. 16, 17, 18, 21, 21, 22, and 23. It is appreciated, however, that any firing assembly for firing projectiles such as paintballs under the force of compressed gas may be used in a built-in, interior paintball loader arrangement of the present invention. In order for the firing assembly to be fully removable when field-stripping the compressed gas gun, as discussed in greater detail herein, the firing assembly should be a removable unit containing all, some or most of the components needed to chamber and fire a projectile, such as, for example, the bolt, valving system, and electronics.

The exemplary compressed gas gun firing assembly 728 illustrated, and shown in greater detail in FIGS. 13, 15, 16, 17, 18, 21, 22 and 23, includes a housing portion 729 generally defining a breech area 770, with a generally cylindrical interior portion. A bolt 730 having a channel (or bolt passage) for communicating gas therethrough is provided in the forward portion of the housing movable from a first or rearward or ready-to-fire or loading position to a second or forward or firing position. The bolt 730 is biased by a bolt spring 731 to a rearward position. The bolt coaxially surrounds a bolt guide 736, which is stationary in the housing. A channel runs through the bolt guide 736, providing fluid communication from a rear portion of the housing to the bolt and a forward portion of the housing.

A velocity adjuster 744 may be provided to the rear of the valve housing 771, which can be adjustment to control the volume of the valve housing 771, and this controls the velocity of projectile firing based on compressed gas volume.

A transfer tube or compressed gas tube 739 is provided, positioned within the body, providing a compressed gas channel 740 for communicating compressed gas from a compressed gas tank, as regulated by the regulator 745, to the valve housing 771 of the firing assembly 728.

Compressed gas from the compressed gas tube 739 flows into a poppet or valve housing 771 of the housing. The valve housing 771 may comprise a compressed gas area or chamber 738 for receiving compressed gas from a source of compressed gas such as a gas tank. A poppet 732 is positioned in the valve housing 771 of the housing and moveable from a rearward to a forward position. The poppet 732, in the forward position, is positioned adjacent a rear opening in the bolt guide, closing a flow path or channel F. The poppet 732 includes a gas channel 772 through the body of the poppet 732, permitting compressed gas in the valve housing 771 to flow through the poppet valve body to the rear of the poppet valve. Due to differences in forward and rearward facing surface areas of the poppet 732, compressed gas in the valve housing acts to move the poppet to the forward (or closed) position when the gun is not being fired. Thus, a pressure controlled poppet valve is provided. A poppet spring 733 may also be provided to the rear of the poppet 732, biasing the poppet to the forward or closed position.

The control unit 716 (or "control circuitry" or "control electronics") of the compressed gas gun may include a circuit board 717 including control circuitry for controlling operations of the compressed gas gun, and including a controller such as a microprocessor 718. Upon pulling, depressing, or otherwise actuating the trigger, the control unit 716 sends a signal to a solenoid valve 741, positioned adjacent the compressed gas tube 739 and in the example gun shown, below the housing 771. The solenoid valve 741 includes a plunger or stopper 742 that regulates a flow of compressed gas through a channel 743 providing communication between a rearward portion of the valve housing 771 behind the poppet, and a rearward facing portion of the bolt. The stopper 742 is configured to move from a closed position, where the channel 743 is blocked, to an open position allowing for fluid communication.

Figure 17:
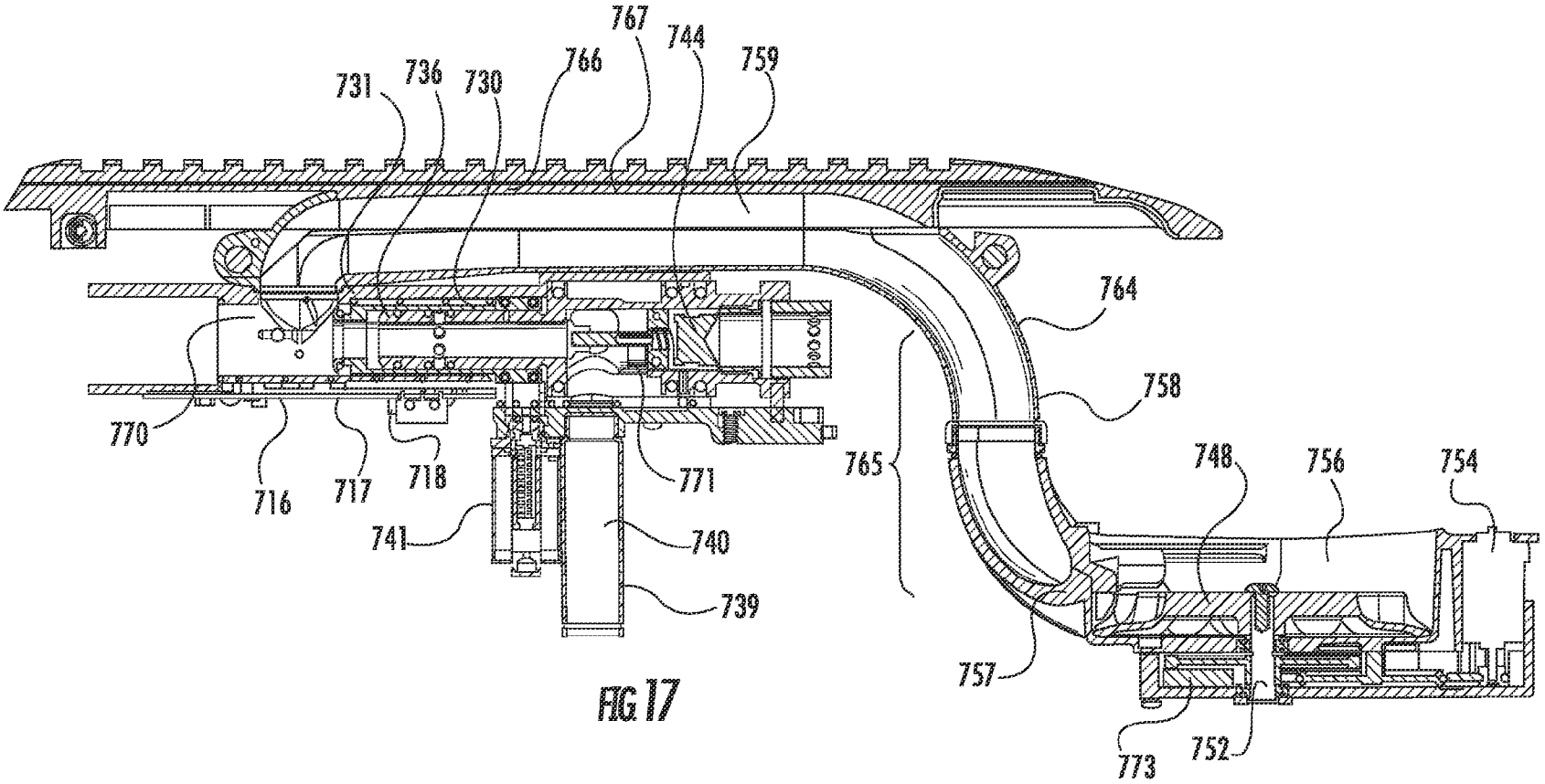
FIG. 17 shows a cross-sectional left side view of an exemplary top rail assembly, upper wall, firing assembly, feed tube, and projectile feed mechanism of a compressed gas gun according to the present invention.
Figure 18:
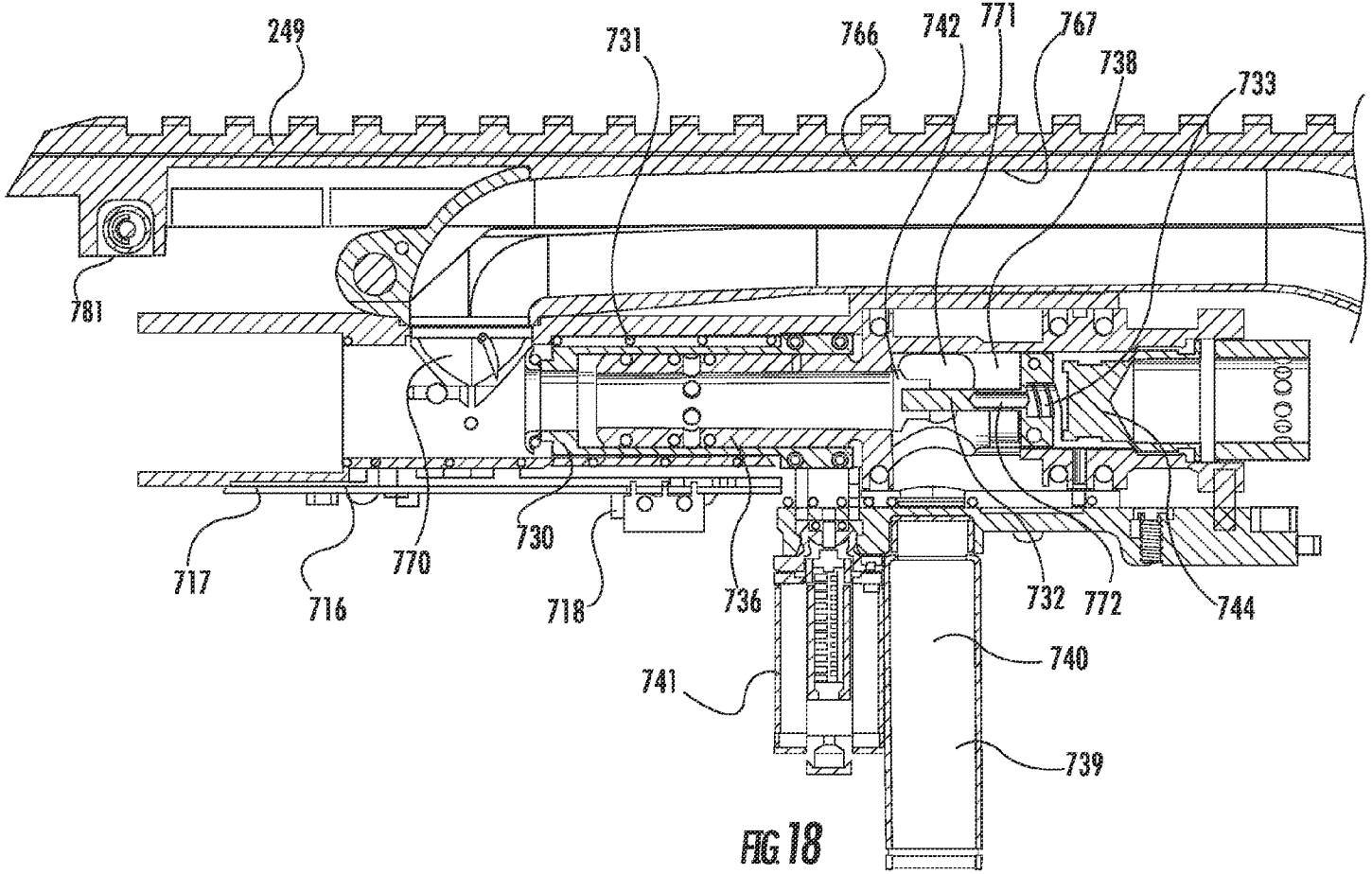
FIG. 18 shows a closer view of an exemplary a cross-sectional left side view of an exemplary portion of a top rail assembly, upper wall, firing assembly, and portion of the feed tube of a compressed gas gun according to the present invention.

In the open position, compressed gas from the valve housing 771 is communicated to the bolt 730 through a gas channel. This has several effects. The compressed gas acting on the bolt 730 will move the bolt forward (toward a firing position) against the force of the bolt spring 731 toward a firing position, which will act to chamber a paintball that has entered the breech area through the breech opening 761. The imbalance of gas pressure on the poppet 732, since gas is being vented from the space to the rear of the poppet, will cause the poppet to move to the rearward or open position. This will open a flow path or channel F allowing the compressed gas to flow through the bolt guide and bolt to fire a paintball (projectile) from the gun. When the bolt is in the firing position, the poppet is configured to move to the rearward position, at least for the time needed to provide a firing charge of compressed gas, and compressed gas flows from the valve area 771 through the flow path F opened by the poppet 732, and through the opening in the bolt to fire a projectile through and out the barrel. This system will reset when the solenoid valve plunger again closes the gas channel, and the pressure differential will force the poppet to the forward or closed position, as shown in FIGS. 17 and 18, for example.

Figure 27:
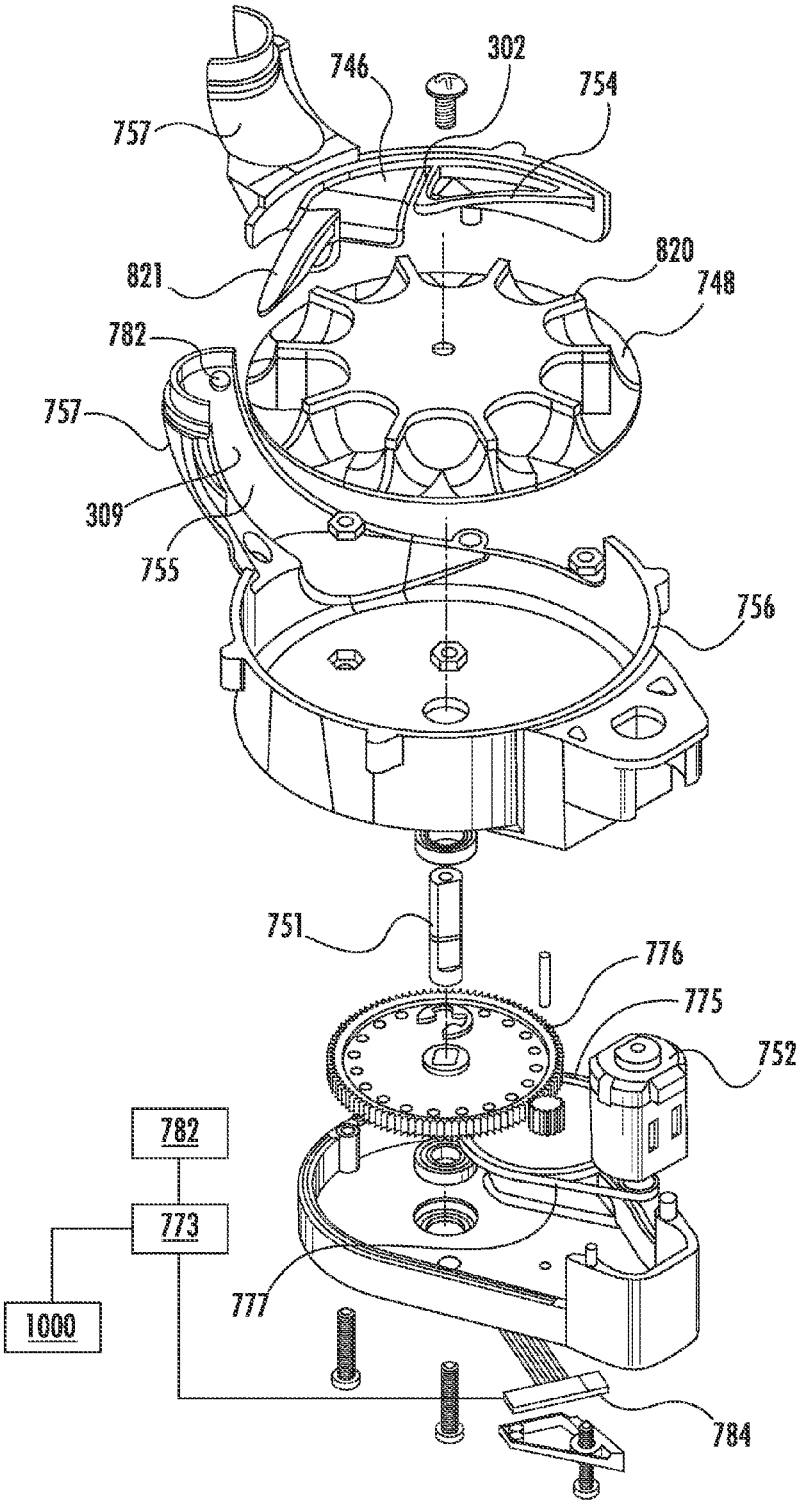
FIG. 27 shows an exploded view of an exemplary projectile feed mechanism of the present invention.
Figure 28:
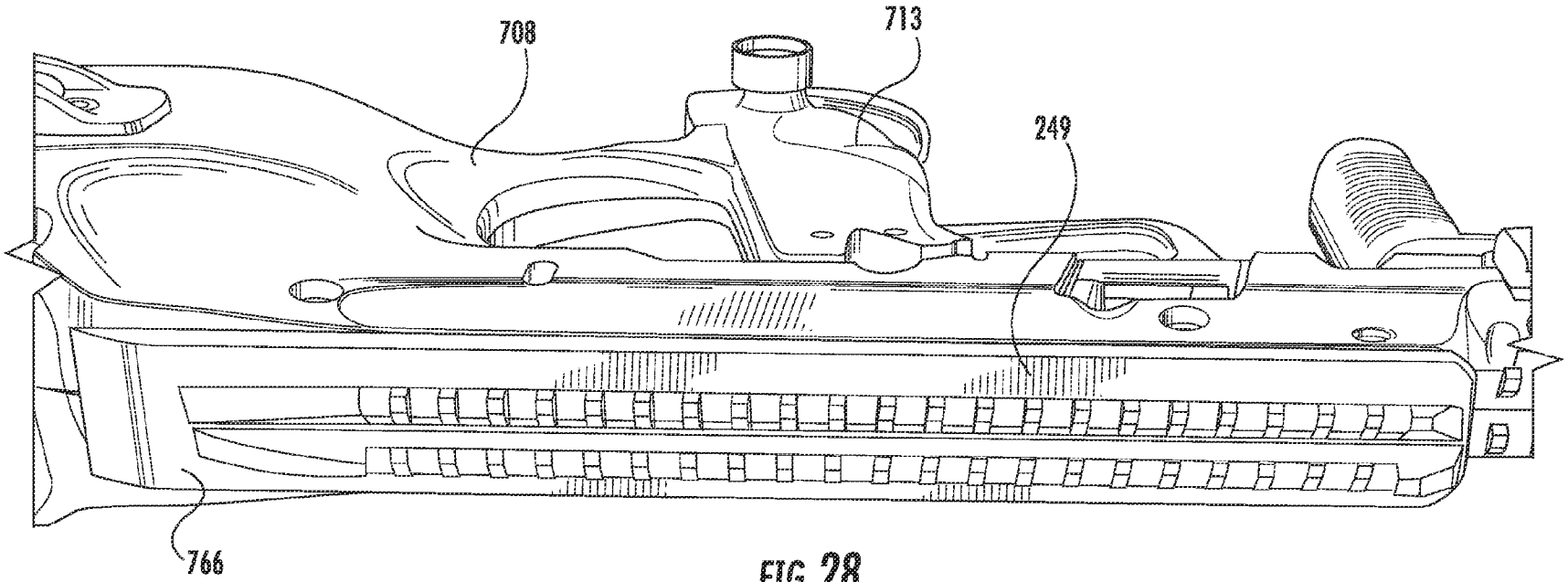
FIG. 28 shows a portion of an exemplary compressed gas gun according to the present invention with the top rail assembly attached.

As shown in greater detail in FIGS. 12, 13, 14, 15, 16, 17, 19, 21, and 27, with an exploded view shown in FIG. 27, the compressed gas gun according to the present invention further includes a built-in projectile feed mechanism 747 comprising a feeder portion 804, housed in the projectile feed mechanism portion 721 of the gun body 701, which may be the rear or butt stock 933 of the gun body 701. The entire projectile feeding mechanism 747, and a feed ramp 227 (also referred to as feed tube 764), is housed essentially completely internally within the body 701 of the compressed gas gun. Not only does this provide a single unit of a compressed gas gun and paintball loader in one integral body, but the positioning of the projectile feeding mechanism as in the present invention in the rear portion 705 of the compressed gas gun body 701 allows the paintball loader to act as a butt stock 933 of a generally rifle-shaped compressed gas gun. Since the projectile feeding mechanism is effectively in-line with the rest of the compressed gas gun and/or compressed gas gun body 701, rather than sitting atop of or below the compressed gas gun body, it reduces the target for paintballs to hit during paintball sport game play. The projectile feeding mechanism portion is preferably positioned horizontally lower (along a lower horizontal plane) than the firing assembly, as in butt stocks of rifles. Moreover, the projectile feeding mechanism cannot "fall off" the gun body, as it is internal and fully contained.

Figure 20:
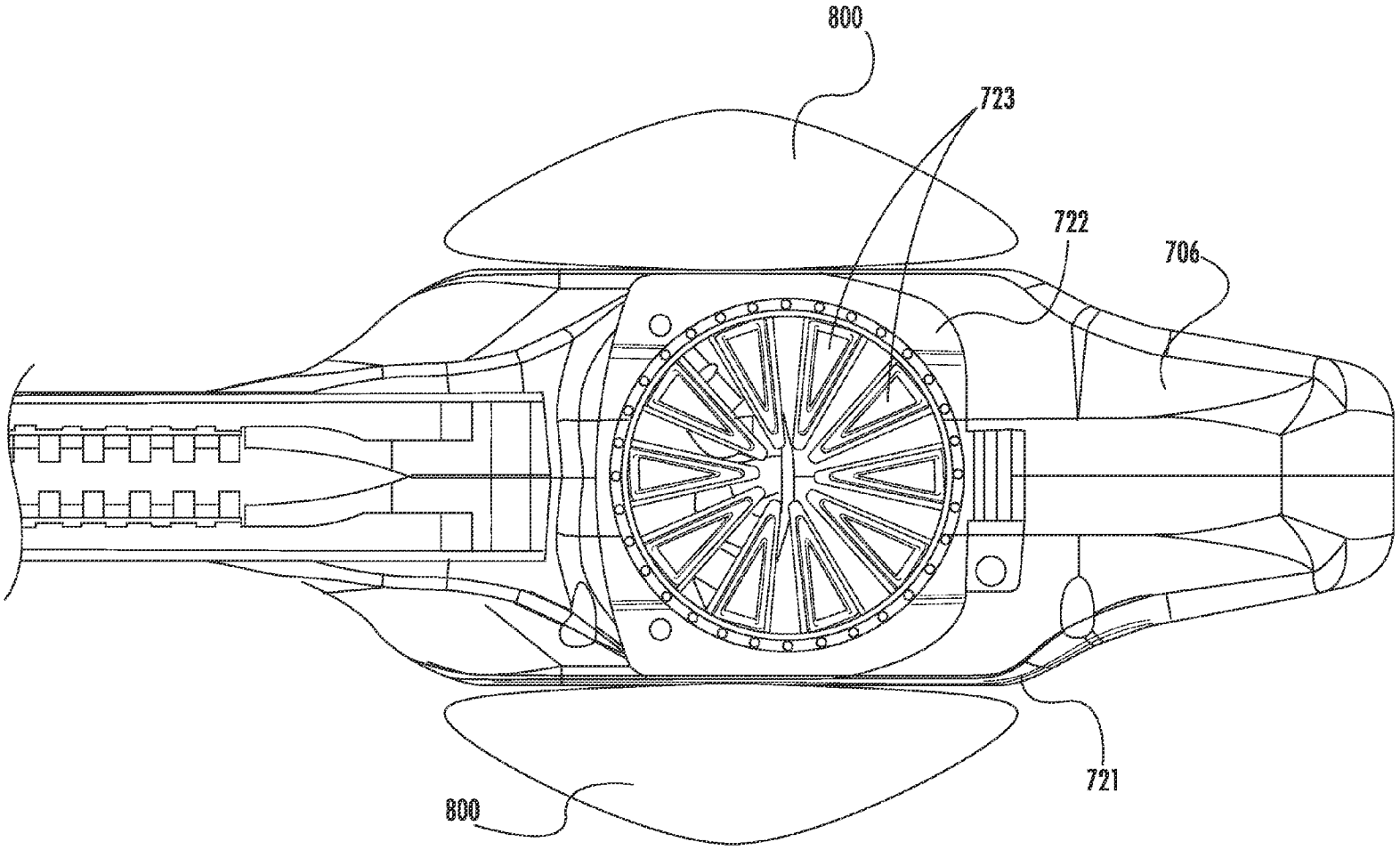
FIG. 20 shows a top view of an exemplary rear portion of an embodiment of a compressed gas gun according to the present invention, with reservoir extenders.
Figure 21:
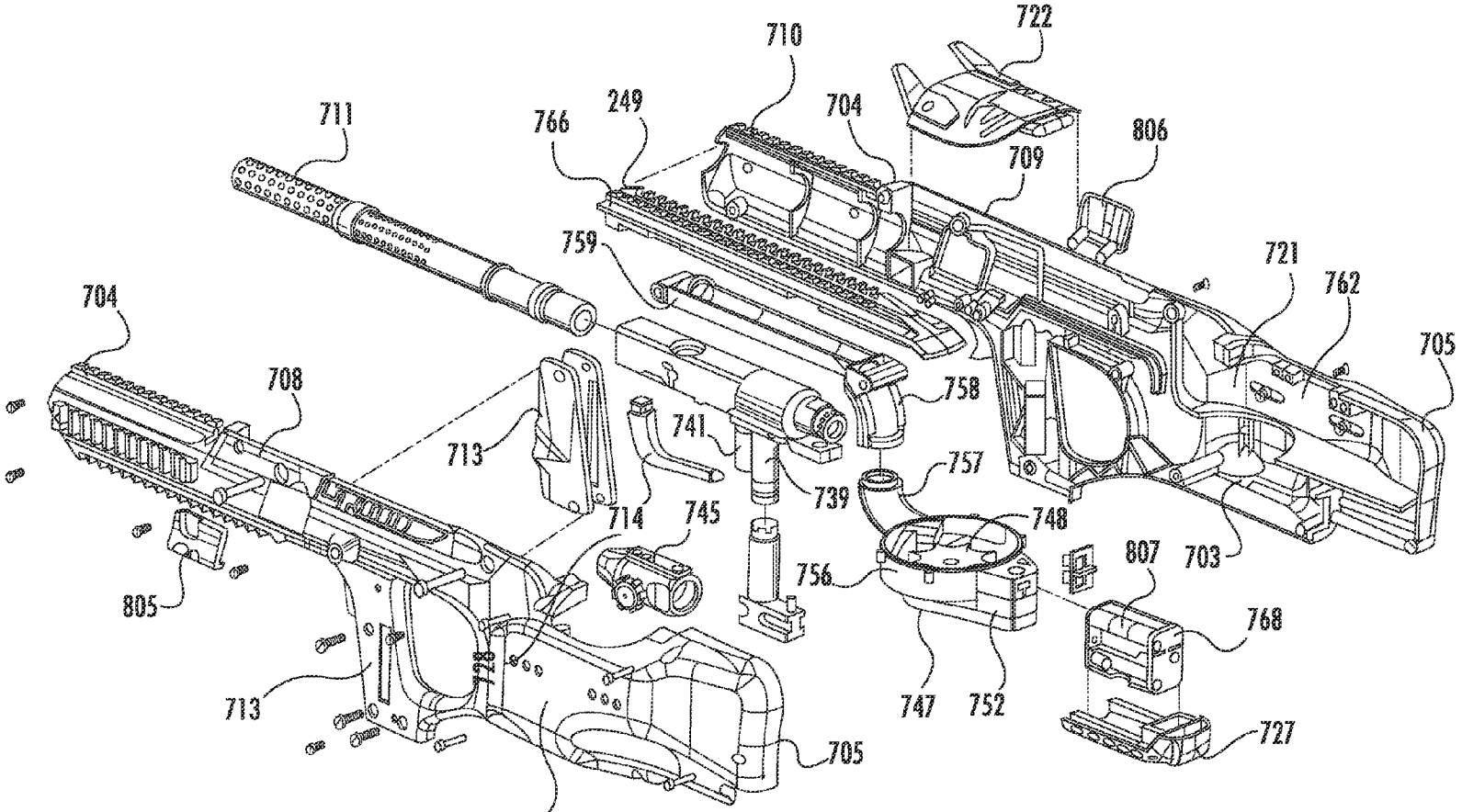
FIG. 21 shows an exploded view of an exemplary compressed gas gun according to the present invention.
Figure 22:
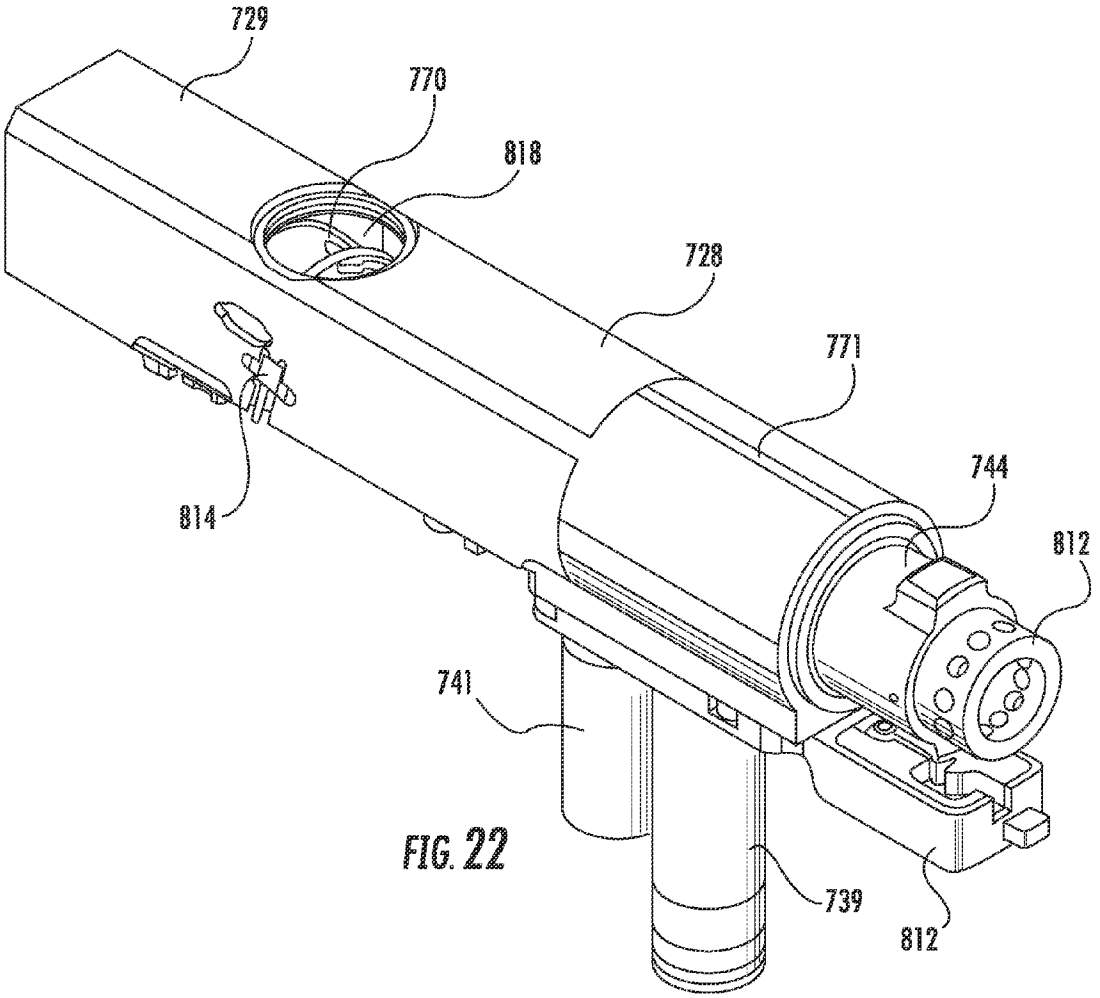
FIG. 22 shows an exemplary firing assembly for a compressed gas gun according to the present invention.

A portion of the interior space or projectile reservoir 762 is provided in the body 701 at the upper part of the projectile feed mechanism portion for receiving and storing projectile (paintballs), as in a conventional paintball loader. The reservoir 762 is sized to hold upwards of 50 or more paintballs, and preferably holds over 200 paintballs. In addition, as shown in FIG. 20, body extender portions 800 may be provided, which increase the capacity of the reservoir such as up to 250, 300, or more paintballs. This can be provided as "bubble" extender portions 800 that increase the capacity of the reservoir, and could either be on the right or left side of the compressed gas gun body, taking into account whether the user is right or left handed. The extenders portions 800 have openings in communication with the reservoir 762 provided in the body 701, or replace removable sidewalls adjacent the reservoir 762.

Figure 19:
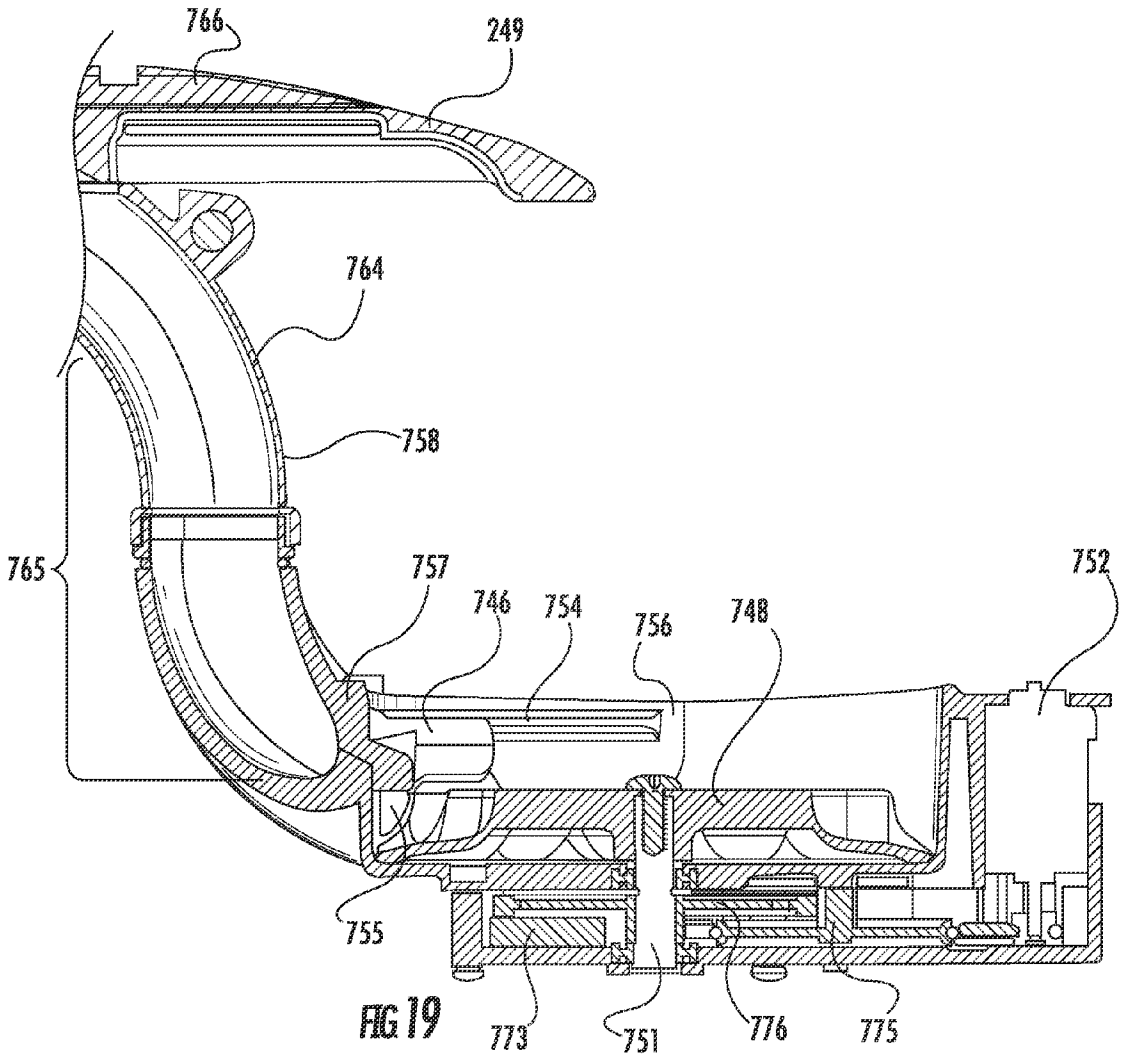
FIG. 19 shows a closer view of a cross-sectional left side view of an exemplary portion of a top rail assembly, feed tube and projectile feed mechanism of a compressed gas gun according to the present invention.

As shown in FIGS. 12-15, the projectile feed mechanism 747 is provided at a lower portion of the interior space 703 of the gun body 701. As shown in FIGS. 17, 19 and 27, the projectile feed mechanism 747 preferably includes a feeder 748 rotatable about a central axis 'A' within a catch cup 756, with a drive shaft 751 powered by a motor 752 having a power source such as a battery. The catch cup 756 includes annular walls for containing paintballs driven by the feeder 748.

The feeder 748 preferably includes at least one or a plurality of arms, fins, or extensions 820 forming at least one space or pockets, gaps or spaces 749 for receiving projectiles placed in the interior space, which may fall by gravity into the spaces 749. The feeder 748 has a generally outwardly and downwardly sloping feed surface along its circumference for guiding and/or receiving paintballs into the spaces 749. The feeder 748 may have an overall conical or frusto-conical shape. The feeder and feeding mechanism may be designed as in U.S. Pat. No. 6,109,252, the entire contents of which are incorporated by reference as if fully set forth herein.

In a preferred embodiment, as shown in FIGS. 19 and 27, a belt drive system may be utilized for rotating the feeder, as described in U.S. Pat. No. 7,343,909, the entire contents of which are incorporated by reference as if fully set forth herein. The drive shaft 774 may project downward to engage a drive member 776 that is part of the drive mechanism such as a gear or series of gears driven by a motor 752. The drive member 776 may be a gear having a plurality of spaced apart gear teeth. The gear teeth are adapted to engage with mating teeth on a second gear 775 having a drive belt 777 connected to the drive shaft and/or motor 752. While the drive member in the illustrated embodiment is a gear, other types of conventional drive members can be used to produce controlled rotation, such as a pulley mechanism or stepper motor.

It will be appreciated that the above embodiment of the drive mechanism is an illustrative embodiment only, and that other drive suitable drive mechanisms may be used. For example, the drive shaft can be coupled directly to the motor.

Rotation of the feeder 748 drives projectiles 142 toward the exit opening 755, which may generally be an opening in a wall of the catch cup 756. In the preferred embodiment, the exit opening 755 is at a forward end of the feed mechanism. A catch arm or tube extension 746 and/or deflector 754 may be provided for guiding paintballs from the feeder and into the exit opening, and preventing projectile jams or misfeeds, as described in U.S. Pat. Nos. 6,213,110, 6,502,567, and 6,792,933, the entire contents of all of which are hereby incorporated by reference as if fully set for the herein.

An electrical or electronic system for operating and/or controlling the projectile feed mechanism and motor 752 is provided. FIG. 27 also shows, schematically, the electronics and/or control circuitry that may be provided to control operation of the projectile feed mechanism. A feed sensor 784 or breech sensor 814 may be in communication with paintball feed mechanism control circuitry 773 (such as electronics or electrical circuitry). Such paintball feed mechanism control circuitry 773 may also be in communication with control unit 716 (alternately described as part of central control unit 1000), described in greater detail herein. The communication may be wired or wireless. In this embodiment, separate paintball control circuitry 773 may be provided in communication with the feed mechanism. The projectile loader control circuitry 773 may include a microprocessor in communication with one or more sensors. Also, sensors 784 and/or 782 may be directly in communication with control unit 716 (alternately described as part of control unit 1000), so that a single control unit controls both the feed assembly 728 and the projectile feed mechanism 747.

Thus, in a preferred embodiment, the central compressed gas gun control unit 716 may also control operation of the projectile feed mechanism 747 as well. In addition, a single circuit board 717 or control circuitry can also be used to control both the firing assembly 728 and the projectile feed mechanism 747, and can be powered by a single power source (e.g. battery or batteries), thus eliminating the need for additional circuitry, controllers or batteries.

The control circuitry 773 and/or the compressed gas gun control unit 716, or central control unit 1000, may have some or all of the following features. A contact, sound, pressure or shock sensor, or detector 780 may be provided configured to detect a signal based on a compressed gas gun firing event, or sound, or other pressure waves in a medium, and operate the motor in response thereto, such as in U.S. Pat. Nos. 5,947,100 and 5,791,325, the entire contents of all of which are hereby incorporated by reference as if fully set forth the herein. In this arrangement, the detector 780 will detect or sense a firing event (e.g., sound, pressure waves in a medium, shock waves, a trigger pull, bolt movement, hammer movement, an electronic signal indicative of a compressed gas gun being fired, projectile movement), and send a signal indicative of such a firing event to control units, control circuitry and/or electronics of the compressed gas gun and/or the projectile feed mechanism. The control units, control circuitry and/or electronics will process and determine the proper action and/or adjustment in response to such a signal, such as operating and/or otherwise controlling the motor (starting, stopping, speeding up, reversing, or slowing down) of the projectile feed mechanism, updating information regarding the firing parameters (e.g., rate of fire, valve dwell time, velocity, gas expended, shot count, ramping) of the compressed gas gun, regulating the firing parameters of the compressed gas gun, or similar adjustments or actions, or any combination thereof.

As shown in FIG. 27, one or more break-beam, optical, or infra-red sensors 782 may be provided to detect paintballs or the movement of paintballs at a selected position in the feed mechanism, such as in the feed tube, and control the motor of the feed mechanism in response to such detection, as in U.S. Pat. No. 5,816,232; 6,213,110; 6,502,567; or 6,792,933, the entire contents of all of which are hereby incorporated by reference as if fully set forth herein. In this arrangement, the sensor 782 will detect or sense a projectile or projectile movement, and send a signal indicative of such projectile or projectile movement to control units, control circuitry and/or electronics of the compressed gas gun and/or the projectile feed mechanism. The control units, control circuitry and/or electronics will process and determine the proper action and/or adjustment in response to such a signal, such as operating and/or otherwise controlling the motor (starting, stopping, speeding up, reversing, or slowing down) of the projectile feed mechanism, updating information regarding the firing parameters (e.g., rate of fire, valve dwell time, velocity, gas expended, shot count, ramping) of the compressed gas gun, regulating the firing parameters of the compressed gas gun, or similar adjustments or actions, or any combination thereof.

Figure 23:
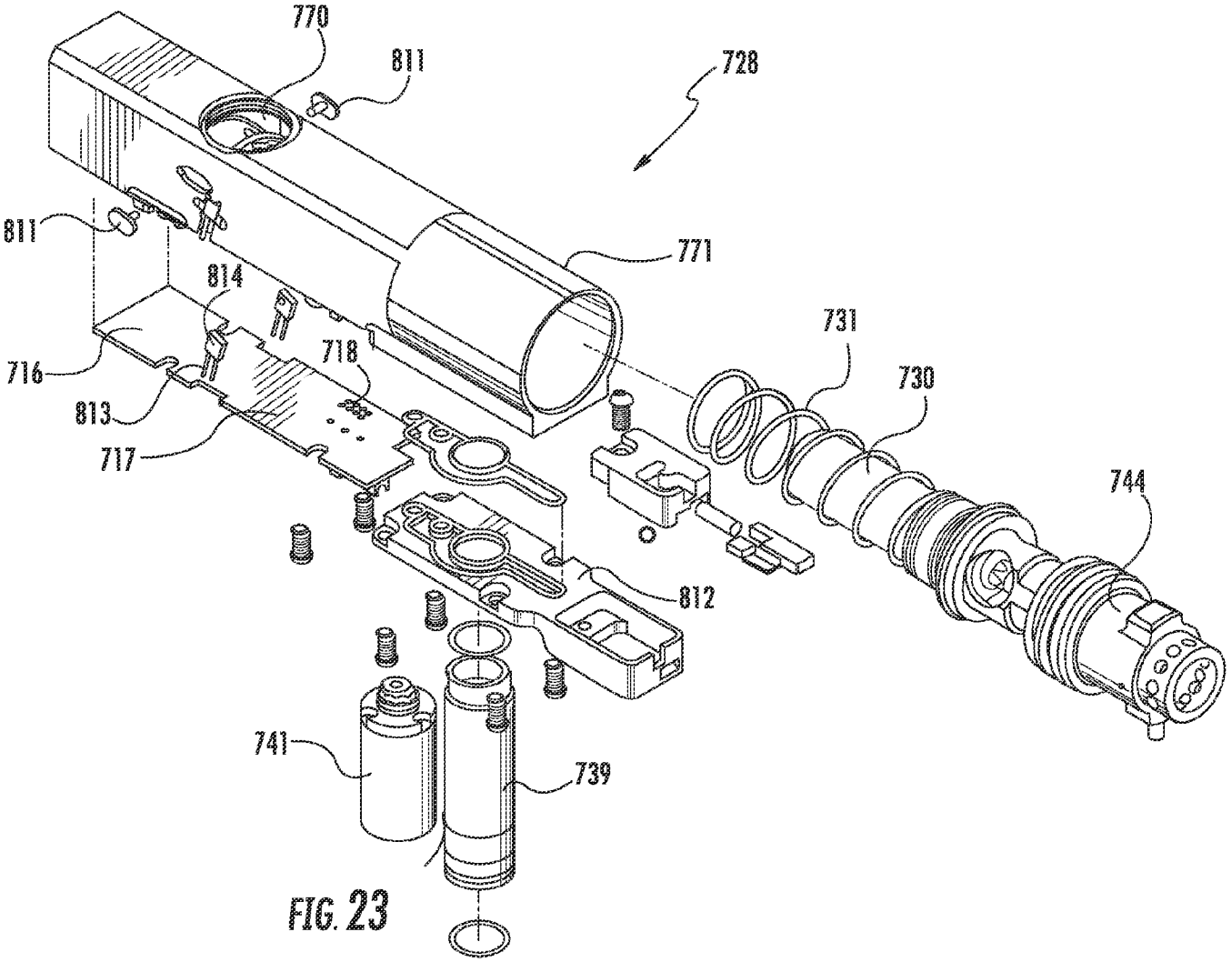
FIG. 23 an exploded view of an exemplary firing assembly for a compressed gas gun according to the present invention.

As shown in FIG. 23, one or more breech sensors 814 may be provided for sensing projectiles within the breech area 770. In this arrangement, the sensor 783 will detect or sense a projectile or projectile movement, and send a signal indicative of such projectile or projectile movement to control units, control circuitry and/or electronics of the compressed gas gun and/or the projectile feed mechanism. The control units, control circuitry and/or electronics will process and determine the proper action and/or adjustment in response to such a signal, such as operating and/or otherwise controlling the motor (starting, stopping, speeding up, reversing, or slowing down) of the projectile feed mechanism, updating information regarding the firing parameters (e.g., rate of fire, valve dwell time, velocity, gas expended, shot count, ramping) of the compressed gas gun, regulating the firing parameters of the compressed gas gun, or similar adjustments or actions, or any combination thereof.

As shown in FIG. 27, a feeder sensor 784 may be provided for detecting movement of the feeder such that the motor may be operated or controlled in response thereto, as in U.S. Pat. No. 6,889,680, the entire contents of which are hereby incorporated by reference as if fully set forth herein. In this arrangement, the sensor 784 will detect or sense the movement, speed, and/or lack of movement or speed of the feeder, and send a signal indicative of such to control units, control circuitry and/or electronics of the compressed gas gun and/or the projectile feed mechanism. The control units, control circuitry and/or electronics will process and determine the proper action and/or adjustment in response to such a signal, such as operating and/or otherwise controlling the motor (starting, stopping, speeding up, reversing, or slowing down) of the projectile feed mechanism, updating information regarding the firing parameters (e.g., rate of fire, valve dwell time, velocity, gas expended, shot count, ramping) of the compressed gas gun, regulating the firing parameters of the compressed gas gun, or similar adjustments or actions, or any combination thereof.

A sensor or sensors in communication with one or more transmitters 786 and receivers 788, which may be wired or wireless, may be provided for detecting a firing event and operating the motor in response thereto, as in U.S. Pat. No. 8,448,631, the entire contents of which are hereby incorporated by reference as if fully set forth herein. In this arrangement, the sensor will detect a firing event and a signal will be transmitted via a transmitter to a receiver in communication with the control circuitry indicative of such signal and firing event. The control units, control circuitry and/or electronics will process and determine the proper action and/or adjustment in response to such a signal, such as operating and/or otherwise controlling the motor (starting, stopping, speeding up, reversing, or slowing down) of the projectile feed mechanism, updating information regarding the firing parameters (e.g., rate of fire, valve dwell time, velocity, gas expended, shot count, ramping) of the compressed gas gun, regulating the firing parameters of the compressed gas gun, or similar adjustments or actions, or any combination thereof.

The sensors or detectors described herein may be electrically wired, or operate in a wireless fashion with transmitters and receivers. Any combination of sensors or detectors may be used to control, regulate and/or adjust the operation of the compressed gas gun of the prevent invention. Other means for operating the motor of the feed mechanism may also be provided without departing from the teachings of the present invention.

In order to deliver paintballs from the projectile feed mechanism 747 to the breech area 770 of the compressed gas gun 700, a feed tube 764 (also referred to herein as a "feed ramp" 227) having several identifiable portions is provided, although it is noted that the feed tube 764 may be one piece or several pieces. As shown in FIGS. 12-17, 19, 21 and 27, a first portion 757 of the feed tube is in communication with the exit opening 755 of the catch cup. The first portion 757 is curved, and preferably curves forwardly and upwardly as shown in FIGS. 17 and 19. The first portion 757 is in communication with a second portion 758. The second portion 758 is also curved, curving upwardly and away from the first portion to form a generally "S"-shaped transition portion 765 (which also can be described as having a "wave" shape) of the feed tube 764. The "S"-shaped transition portion 765 is preferable, as the paintballs in a paintball stack forced by the feeder 748 through the feed tube 764 preferably undergo a smooth transition from the paintball feeder and initially upward and toward the breech, through the feed tube 764. This "S"-shaped transition portion 765 of the feed tube assists in preventing paintballs from rupturing or jamming in the feed tube.

A third portion 759, which is generally horizontal, of the feed tube extends from the second portion 758 forward along the compressed gas gun body interior 703, as shown in FIGS. 12-18. As shown, the third portion 759 of the feed tube 764 extends along an upper wall 766 of the interior 703 of the compressed gas gun body. The third portion 759 may be generally horizontal or flat along the majority of its length, or may have a curve in it.

Figure 16:
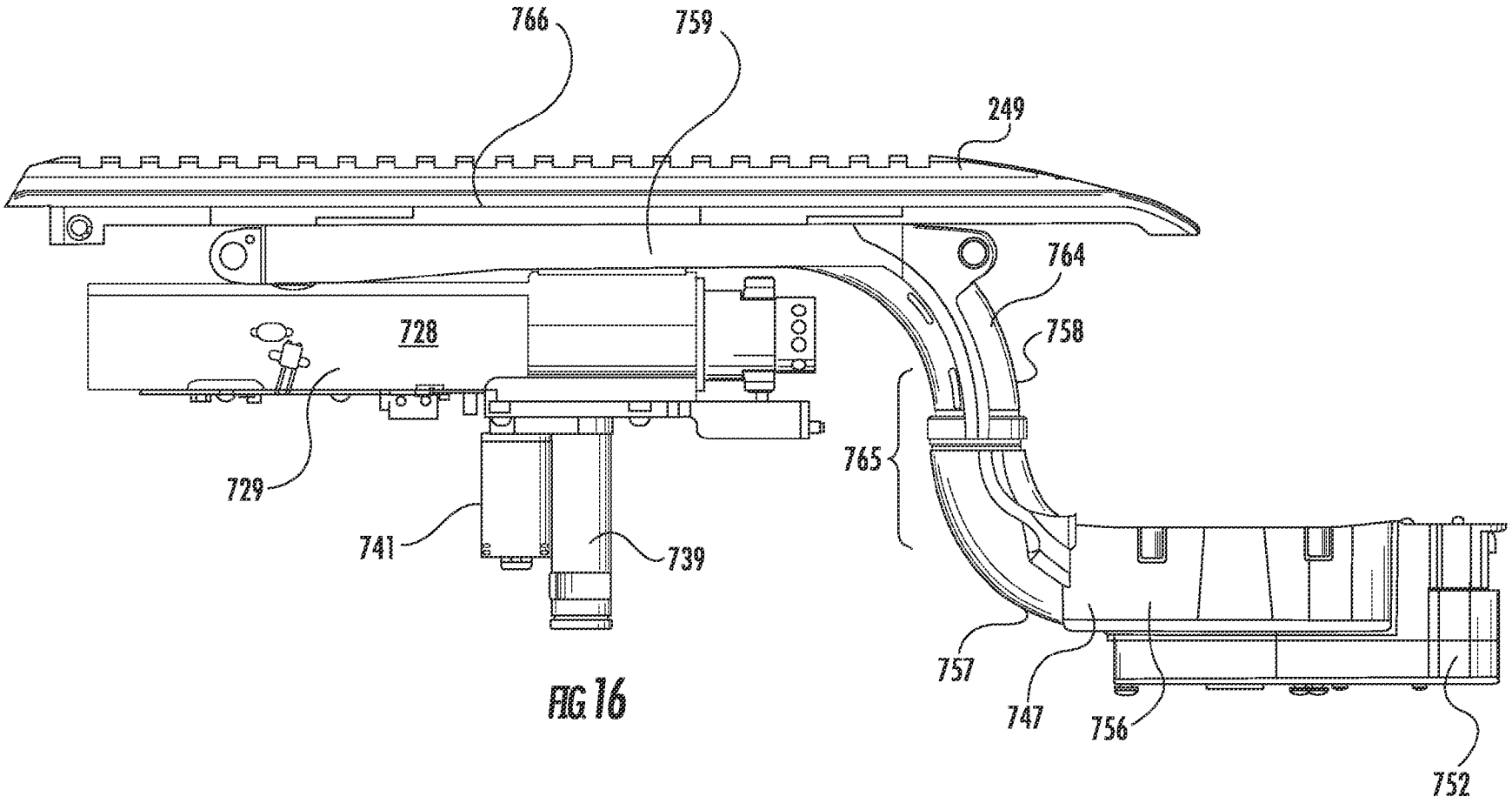
FIG. 16 shows a left side view of an exemplary top rail assembly, upper wall, firing assembly, feed tube, and projectile feed mechanism of a compressed gas gun according to the present invention.

As shown in FIGS. 16-18, in a preferred embodiment, the feed tube 764 comprises, in part, an upper wall 766 formed by an inner surface 767 of the top portion 706 of the compressed gas gun body 701, which may be formed as a removable top rail assembly 249. The inner surface 767 of the upper wall 766 completes the tubular shape of the feed tube 764 along its upper portion. In a preferred embodiment, the upper wall 766 is removable as a top rail assembly 249, exposing an open portion 760 of the gun body interior 703 including a portion of the feed tube 764 for cleaning, maintenance or otherwise gaining access to the interior of the compressed gas gun. Portions of the feeder portion 804 may also be accessible when the upper wall 766 is removed.

In a preferred embodiment, the upper wall 766 is formed as part of a top rail assembly 249, having at an upper surface various rails such as "picatinny" rails, and at a lower surface the upper wall 766 of the feed tube 764 including the inner surface 767. This is shown, for example, in FIGS. 17-19, 24 and 25. This top rail assembly 249 forms a top wall at the upper portion 706 of the compressed gas gun body 701, and can be removed as described herein to provide easy access to the interior 703 of the gun body 701.

The top rail assembly 249 of the compressed gas gun body 701, including the upper wall 766, may be attached and removable by a tongue-in-groove arrangement, by a button release assembly 252, by a pin or pins 781 inserted through holes 125 in the top rail assembly 249 and/or body 701 and/or upper wall 766, it may rotate about a hinge attached at one end to the compressed gas gun body, or may be attached in another manner such as snapping in place, or a combination of any of the foregoing. The top rail assembly 249 of the compressed gas gun body 701, including the upper wall 766, may be attached by magnets to the compressed gas gun body, or by a friction fit.

U.S. patent application Ser. No. 13/835,231, the entire contents of which are hereby incorporated by reference as if fully set forth herein, disclosed a possible arrangement for providing access to the internals of a compressed gas gun, and a similar design may be used in connection with the upper wall 766 of the present design. In such an arrangement, the top rail assembly 249 may be pivotally and/or hingedly attached to the upper portion 706 of the compressed gas gun body 701, and operated as a "flip-up-lid" to expose the interior 703 of the compressed gas gun body 701 for maintenance and adjustments, as described.

As shown in FIGS. 17 and 18, the front end 934 of the third portion 759 of the feed tube 764 curves downwardly at its forward end toward the breech opening 761 of the breech area 770, where a paintball is delivered to the firing assembly 728 for firing by the firing assembly 728 under the force of compressed gas, through the barrel 711. Thus, the feed tube 764 delivers projectiles to the breech area 770 from above the breech area 770. As shown, the arrangement of the present invention permits a complete built-in, internal projectile feed mechanism and loader, housed within the body of a compressed gas gun, yet still allows for projectile loading from above the breech area. This above-breech loading is preferable, as the paintballs do not have to work against the force of gravity when loading into the breech.

As shown in FIGS. 12-15, the projectile feed mechanism 747 is preferably positioned lower (horizontally when the gun is held in a firing position) than the firing assembly 728. This arrangement corresponds to the overall shape of the compressed gas gun, whereby the butt stock is generally ergonomically positioned lower than the breech. In addition, unlike known paintball loaders mounted on top of or beneath a compressed gas gun, the internal paintball loader of the present invention cannot fall off or otherwise be disconnected during use, and cannot get in the way of or otherwise obstruct a paintball sport player. The compressed gas gun may have the projectile feed mechanism 747 positioned in the stock in a "bullpup" type of design, as is known in the art of firearms. The design of the gun of the present invention allows a player in the sport of paintball, for example, to reduce their silhouette and never take a "hit" on an exposed projectile loader.

In operation, when an operator of the compressed gas gun wishes to shoot paintballs, the trigger is squeezed, and the firing assembly operates to chamber and fire a paintball. Paintballs stored in the interior area pass through the feed tube, forced by the feeder, for use by the compressed gas gun when demanded by the operator.

In the preferred embodiment of the present invention, the projectile feed mechanism 747 may include a microprocessor 718 to enhance the performance of the projectile feed mechanism 747 as well as providing useful information to an operator. The microprocessor 718 may control the motor 752 to rotate it in a first direction for feeding, and in a second or reverse direction to clear a jam.

As shown in FIGS. 4-15, a compressed gas gun according to the present invention preferably includes a body 701 or "shell" having a left side portion 708, and a right side portion 709. The two sides 708, 709 are connected (such as by screws or bolts, etc.) to form the complete body 701 that will house the various components, and in particular, will house both the firing assembly 728 and the feeder portion 804.

Referring to FIGS. 4-21, a compressed gas gun 700 according to the present invention preferably comprises one or more of the following components: a removable top rail assembly 249 that forms the upper wall of the body; a "feed ramp" 227 or "feed tube" 764 that acts as a ramp or raceway for conveying projectiles 142 from the feeder portion 804 or the projectile feed mechanism 747 to the firing assembly 728; a left side breech cover 805; a right side breech cover 806; a battery holder 768 including batteries 807; a lid 722 for covering the opening 818 in the body 701 adjacent the projectile feed mechanism portion 721; a compressed gas regulator 809 for controlling the operation pressure of compressed gas supplied to the compressed gas gun from a compressed gas supply (e.g., air or gas tank); a barrel 711; a compressed gas adaptor 810 for attachment to a source of compressed gas such as an air or gas tank; removable pins 781 (removable without the need for tools) for attaching the top rail assembly 249 or upper wall 766 to the body 701; and a grip 713 for grasping or holding the compressed gas gun.

Referring to FIGS. 17, 18, 21-23, an illustrative firing assembly 728 of the compressed gas gun according to the present invention is shown. The firing assembly 728 preferably comprises one or more of the following components: a bolt assembly 730 for chambering and firing a projectile (e.g., a paintball); a solenoid valve assembly 741 that may be initiated by a trigger 715 pull, for regulating the flow of compressed gas to the bolt 730 in order to perform a firing operation; detents 811 for assisting in holding and/or positioning a projectile in place in the breech for firing; a manifold 812 including gas passages for the flow of compressed gas; control unit 716 including a circuit board 717 and preferably including a microprocessor 718, for controlling both the firing operation of the firing assembly 728, and the loading operation of the projectile loader of the compressed gas gun; sensor harnesses 813 including breech sensors 814, for detecting whether a projectile is properly loaded into the breech; an air or gas transfer tube 739 for communicating compressed gas from a source of compressed to the valving system 771 of the firing assembly 728; and a return or bolt spring 731 for returning the bolt to a rearward or ready position.

FIGS. 17 and 27 show the components of a projectile feed mechanism (or paintball loader) according to the invention. A projectile feed mechanism according to the present invention preferably comprises one or more of the following components: a catch cup 756, for holding a feeder 748 and receiving or "catching" projectiles for feeding; a "catch arm" or tube extension 746 for catching and/or guiding projectiles into the exit opening 755; an anti-jam 302 such as a deflector 754, for assisting in preventing projectile jams at the exit opening 755 of the catch cup 756; a drive shaft 751 in communication with drive gears 775, 776 and a motor 752 and a feeder 748, configured for rotation by the motor 752; a feeder 748 (or carrier) for feeding projectiles that is attached to the drive shaft and rotated with the drive shaft by the drive gears and motor; a motor 752, in communication with drive mechanism 775, 776; feed sensor 784 for detecting a position and/or operation of the feeder 748 and providing detection signals to the control circuitry; a projectile sensor 782 for detecting projectiles or the movement or projectiles; a reverse ramp 821, so that when the feeder 748 moves in reverse, projectiles will move up the ramp to prevent jamming; and an exit opening 755 leading to an upwardly turned first portion 757 of an exit ramp or exit tube.

Figure 24:
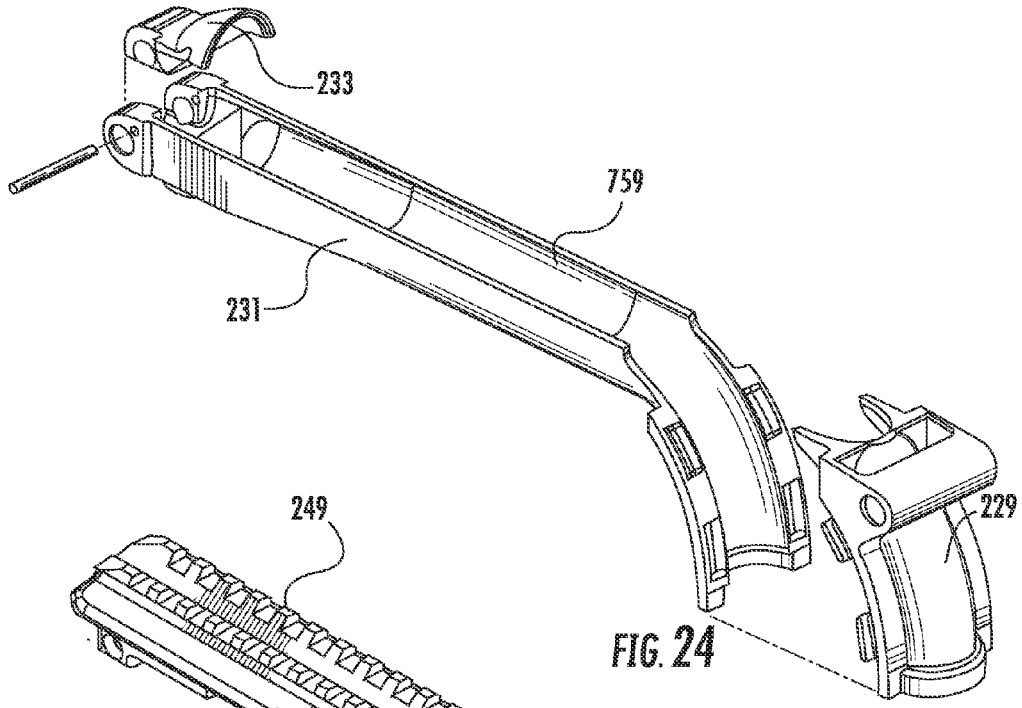
FIG. 24 shows an exemplary feed tube or feed ramp of compressed gas gun according to the present invention.
Figure 25:
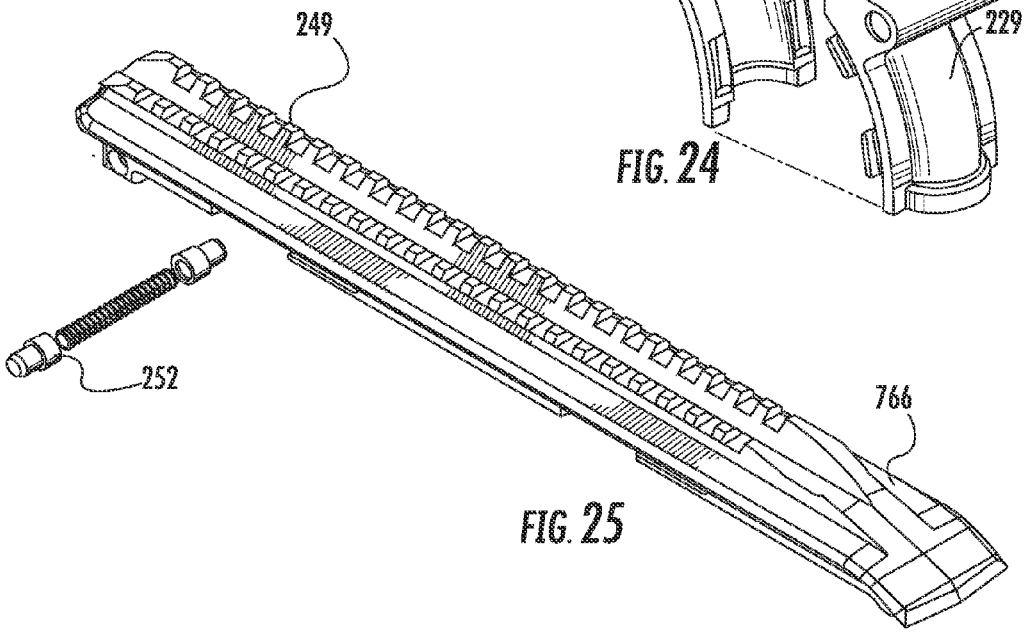
FIG. 25 shows an exemplary top rail assembly of compressed gas gun according to the present invention.

FIGS. 17-19, 2, 24 and 32, show a feed ramp 227 (also described herein with reference to feed tube 764), including a feed ramp back 229, a feed ramp extension 231, and a feed ramp top 233. The feed ramp 227 is in communication with and releasably joins the upwardly turned exit ramp 309 (also described as first portion 757) adjacent the exit opening 755 of the projectile feed mechanism 747. In addition, feed ramp back 229 is releasably attached, such as by flanges and grooves shown in FIG. 24 and such as by a snap fit, to feed ramp extension 231. Projectiles are forced from the projectile feed mechanism 747, along the feed ramp 227, and into the breech area 770 of the firing assembly 728, for firing. As shown in FIG. 24, feed ramp top 233 may be attached to feed ramp back 229 by a spring pin, such that feed ramp top can operate as a flip top that is spring-biased.

FIGS. 21, 25, 31, 32 and 34 show the top rail assembly 249 of the body of the compressed gas gun. The top rail assembly 249 is releasably attached to the body 701 by spring-biased detent or button release assembly 252 which extends through holes 253 in the body 701 of the upper portion of the compressed has gun 700. Pressing the button releases of the button release assembly 252 toward each other against the bias of the spring allows movement of the top rail assembly 249 relative to the upper portion of the body. This provides a "quick release" function for removing the top rail assembly 249.

A tool-less "field strip" of the compressed gas gun according to the invention will now be described, with reference to FIGS. 28-36. The top rail assembly 249 that is preferably completely removable, although a partially removable version is also contemplated. The top rail assembly 249 may slide into place along the top of the top portion 706 of the body 701 of the gun 700, such as by a tongue and groove or flange and groove arrangement. When the top rail assembly 249 is positioned for closing the top portion 706 of the gun body 701, the buttons 252 will be biased by the spring into the holes 253 in the upper portion of the body provided for receiving the buttons. The top rail assembly 249 may be slidable from a first locked (e.g., the buttons are snapped or locked into the holes in the body) position, to a second unlocked position for removal. FIGS. 12-15 and 28 show the top rail assembly 249 in the locked position, with the buttons 252 extending through the holes 253 in the body 701.

Figure 29:
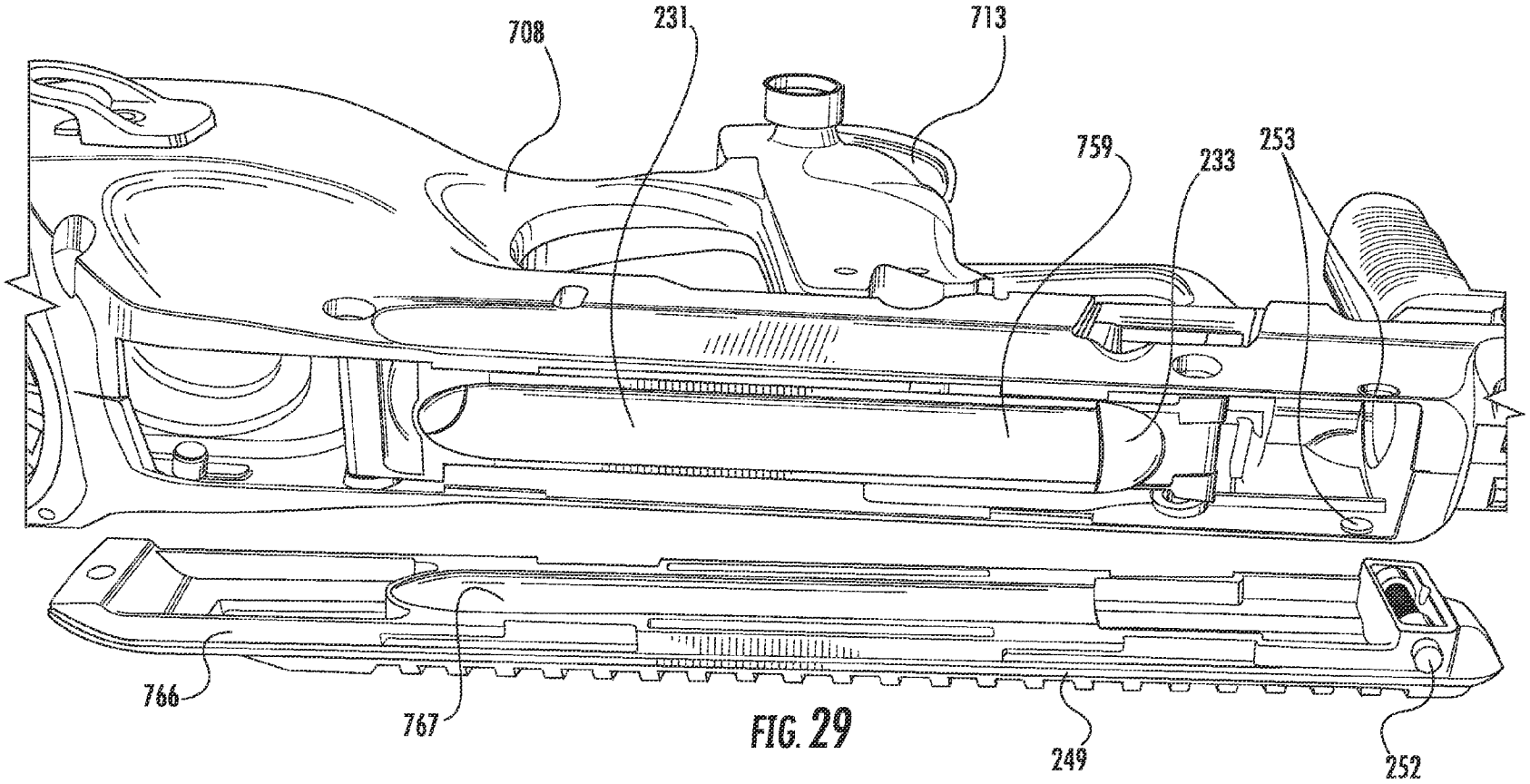
FIG. 29 shows a portion of an exemplary compressed gas gun according to the present invention with the top rail assembly removed exposing the interior of the compressed gas gun body for field stripping.

By depressing the buttons 252, which are accessible when the top rail assembly 249 is in a locked position, the top rail assembly 249 is free to slide to an unlocked position. The top rail assembly 249 can then be completely removed, as shown in FIG. 29, to expose the internals or interior 703 of the gun body 701. The inner surface 767 of the top rail assembly 249, that is, the portion facing the inside of the body of the compressed gas gun, may comprise the top of a feed ramp 227 (or as also described, feed tube 764) for transferring projectiles from the projectile feed mechanism of the compressed gas gun to the elements of the firing assembly 728 (e.g., the breech or bolt). The inner surface 767 is preferably at least partially curved or semi-circular in cross-section forming the upper half of a tube, with the feed ramp extension 231 forming the other part of the tube.

Figure 26:
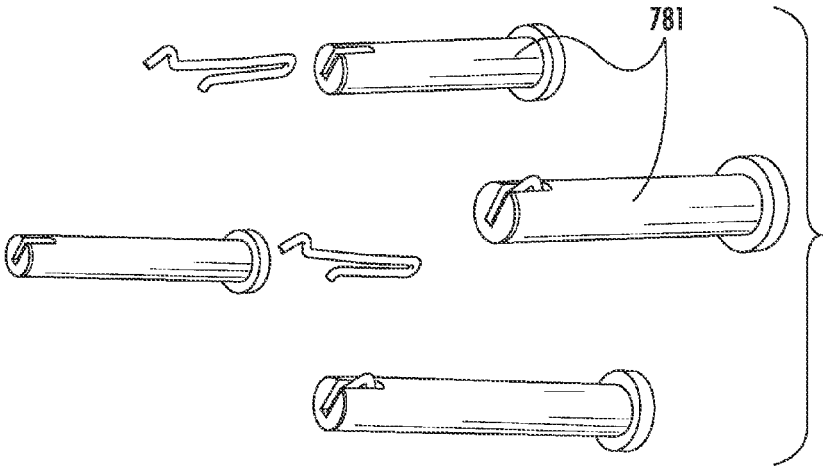
FIG. 26 shows removable pins used to hold components of a compressed gas gun according to the present invention in the interior of the compressed gas gun.
Figure 30:
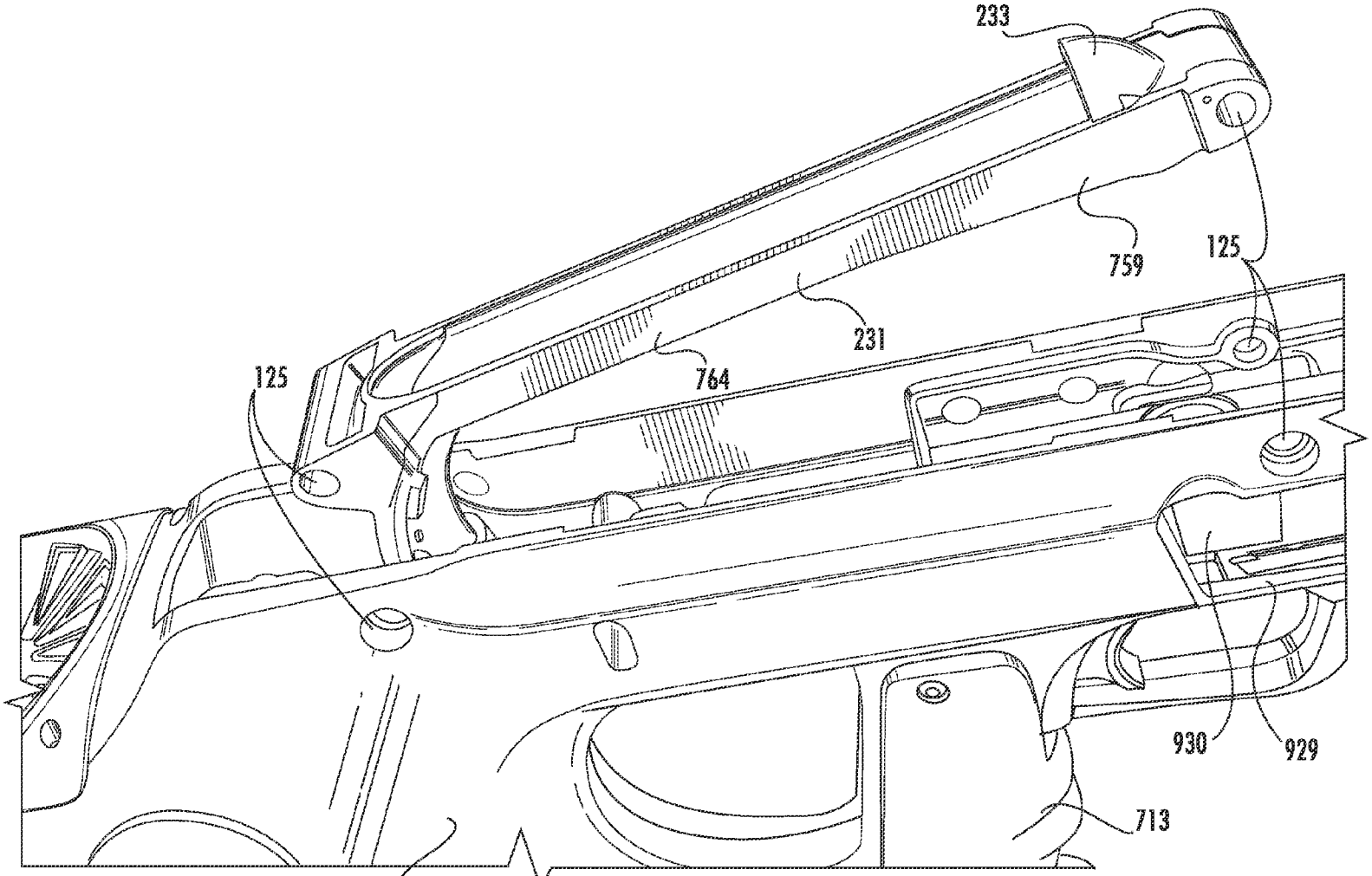
FIG. 30 shows a portion of an exemplary compressed gas gun according to the present invention, viewed from the right side and top, with the feed ramp partially removed from the interior of the compressed gas gun body.
Figure 31:
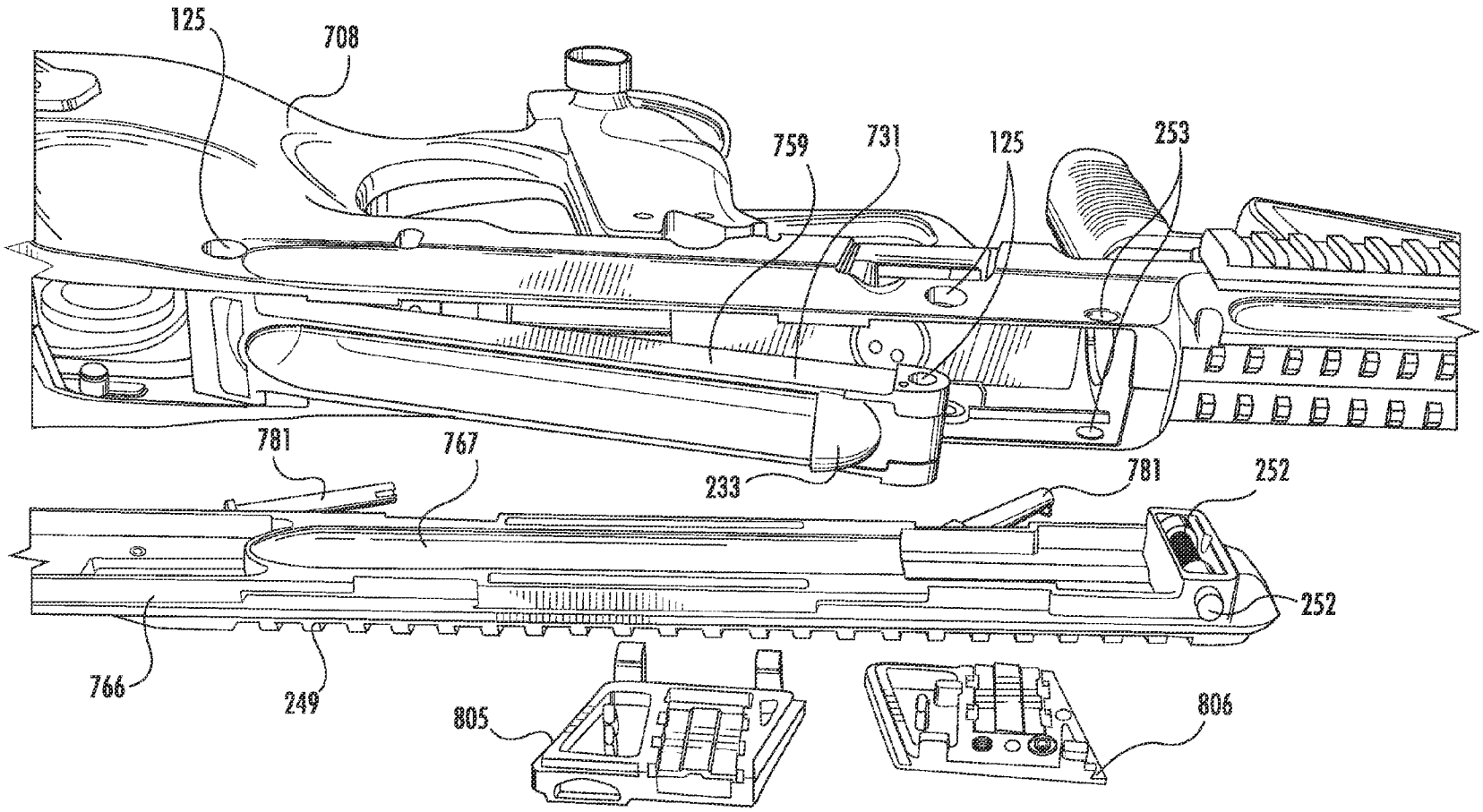
FIG. 31 shows a portion of an exemplary compressed gas gun according to the present invention on its side, with the top rail assembly and breech covers removed, and with the feed ramp partially removed.
Figure 32:
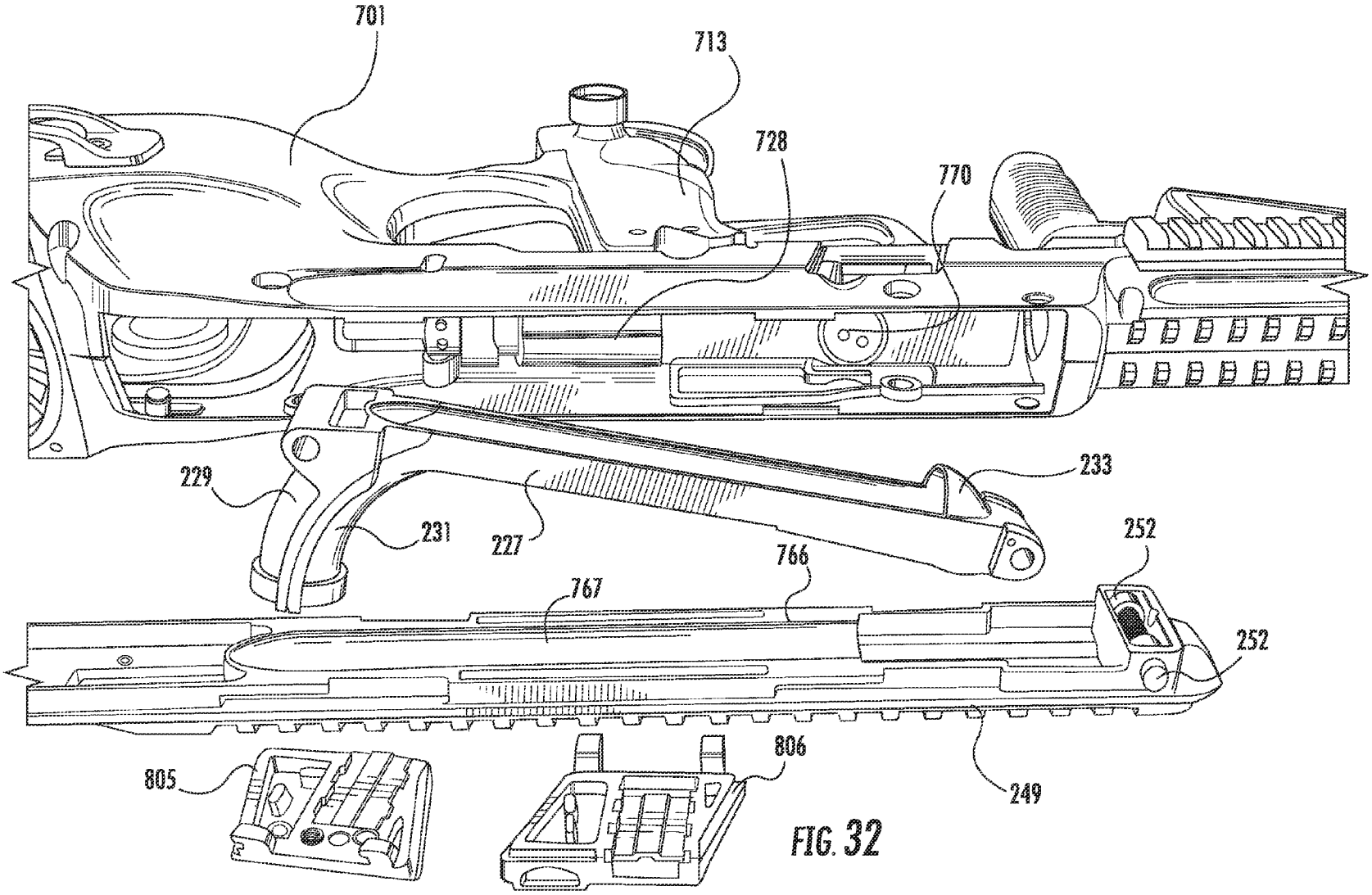
FIG. 32 shows a portion of an exemplary compressed gas gun according to the present invention on its side, with the top rail assembly and breech covers removed, and with the feed ramp completely removed, and exposing the firing assembly in the interior of the compressed gas gun.

Once the top rail assembly 249 is removed, as shown in FIGS. 30-32, the portion of the feed ramp that runs across the top of the gun body can be removed. One or more pins 781 may preferably be used to hold the feed ramp 227 in place. The pins 781 preferably extend through openings 125 in the body and openings in the feed ramp 125, as shown in FIGS. 30-32. The pins 781, shown in detail in FIG. 26, are formed so as to be removable by a person without the need for tools, and have spring biased attachment means for locking in place. The pins 781 may be friction fit with a flange or spring clip to lock in place. The feed ramp 227 may be held in place such as by a snap fit, or a tongue-in-groove fit. The feed ramp extension 231 and feed ramp back 229 may snap together with a flange and grooves as shown in FIGS. 17, 19, 21, 2 and 32, to releasable engage the upwardly turning exit ramp (or "exit tube") 309 (also described as the first portion 757 of the feed tube 764) of the projectile feed mechanism 747.

As shown in FIGS. 30-32, once the pins 781 are removed, the feed ramp 227 can be disengaged and lifted out of the body 701 without the use of tools. FIGS. 31-32 show the feed ramp 227 completely removed from the body 701. In addition, FIGS. 30-32 show the left side breech cover 805 and right side breech cover 806, which are removably attachable to sides of the body adjacent the breech, and which hold the detents 811 in place. Removal of the left side breech cover 805 and right side breech cover 806 provides additional access to the inner portions and interior 703 of the body, adjacent the breech area 770.

Figure 33:
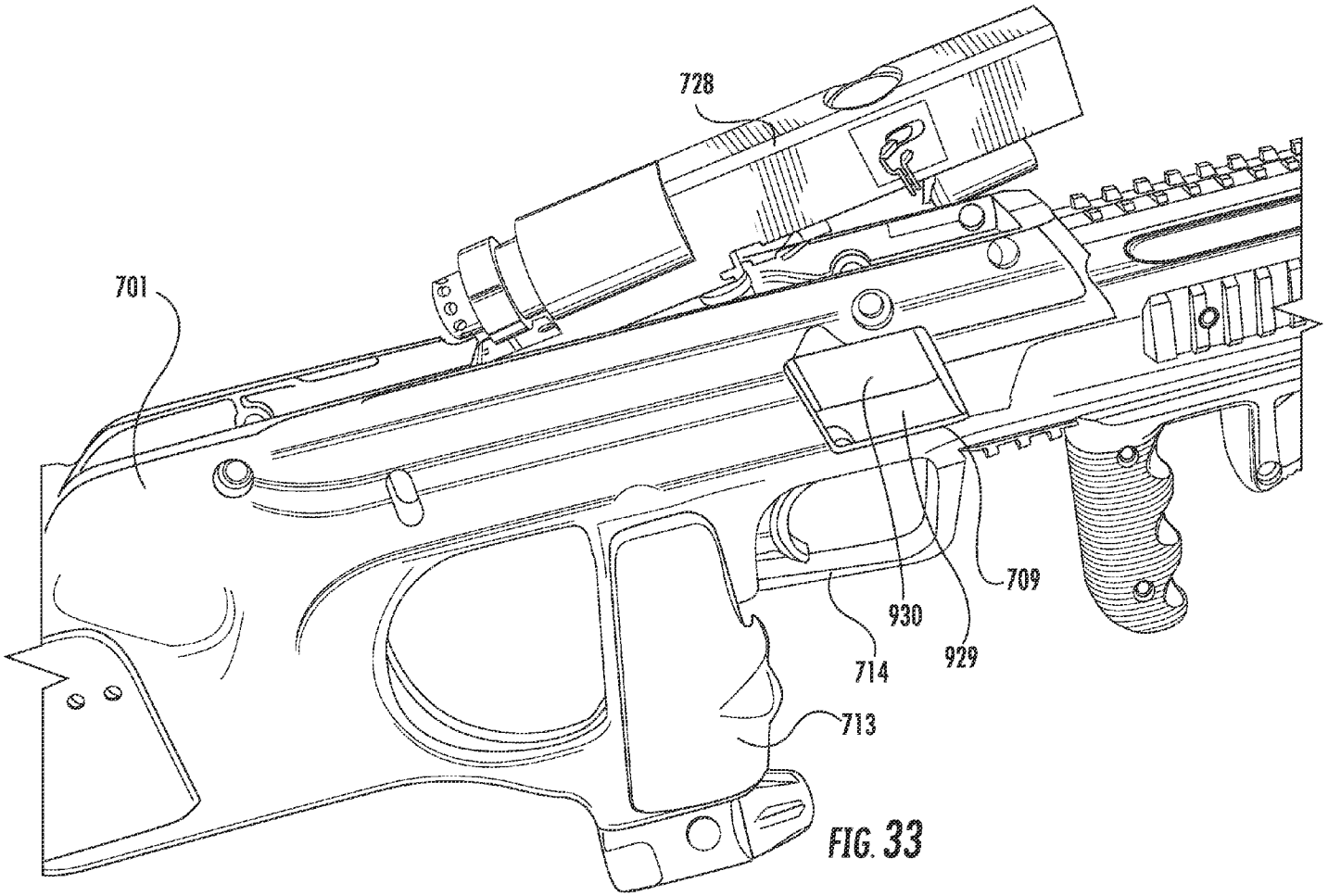
FIG. 33 shows a portion of an exemplary compressed gas gun according to the present invention from the side and top, with the top rail assembly removed, and the firing assembly partially removed from the interior of the compressed gas gun.
Figure 34:
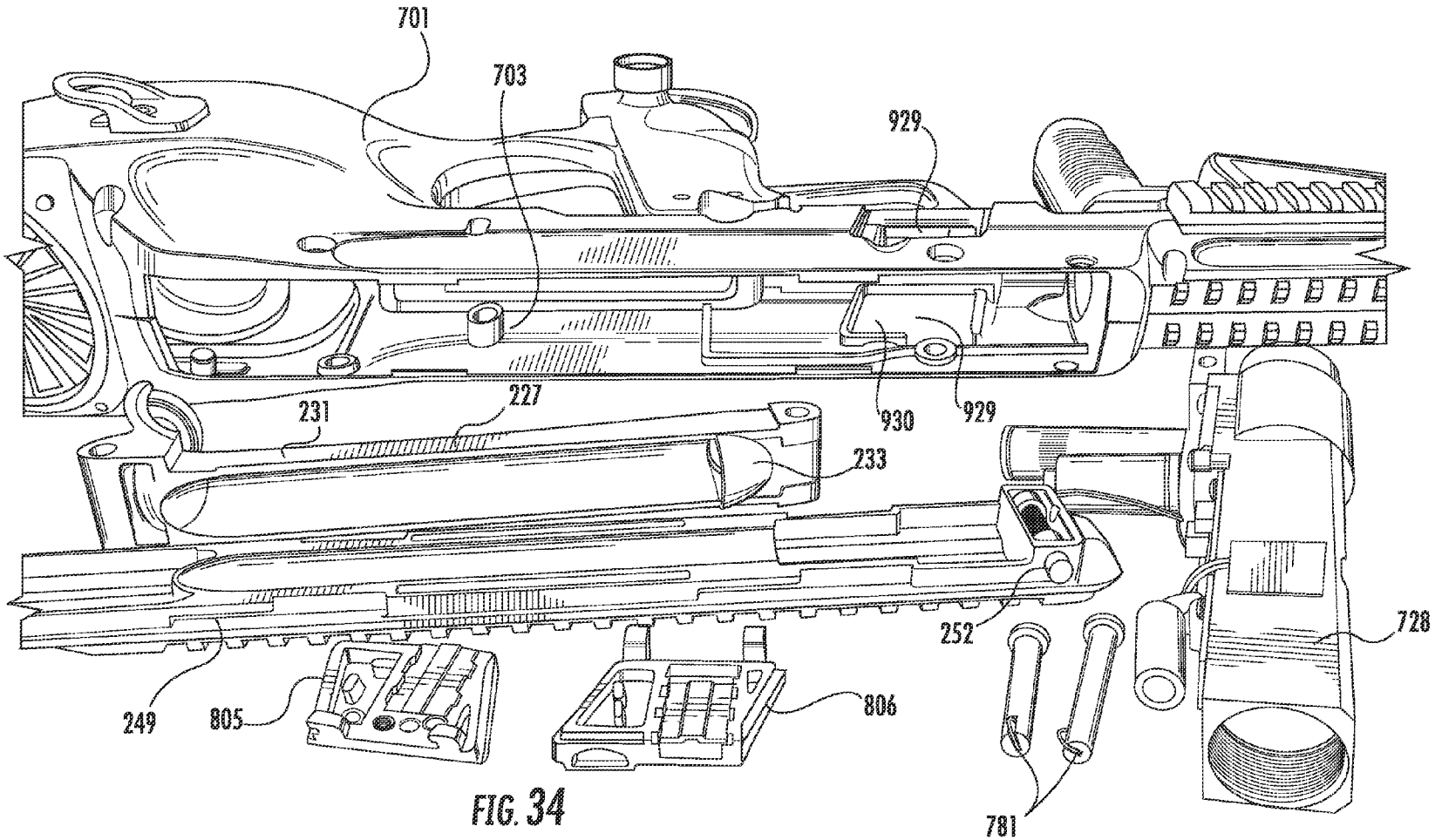
FIG. 34 shows a portion of an exemplary compressed gas gun according to the present invention on its side, with the top rail assembly, breech covers, firing assembly, and pins completely removed from the body of the compressed gas gun.
Figure 35:
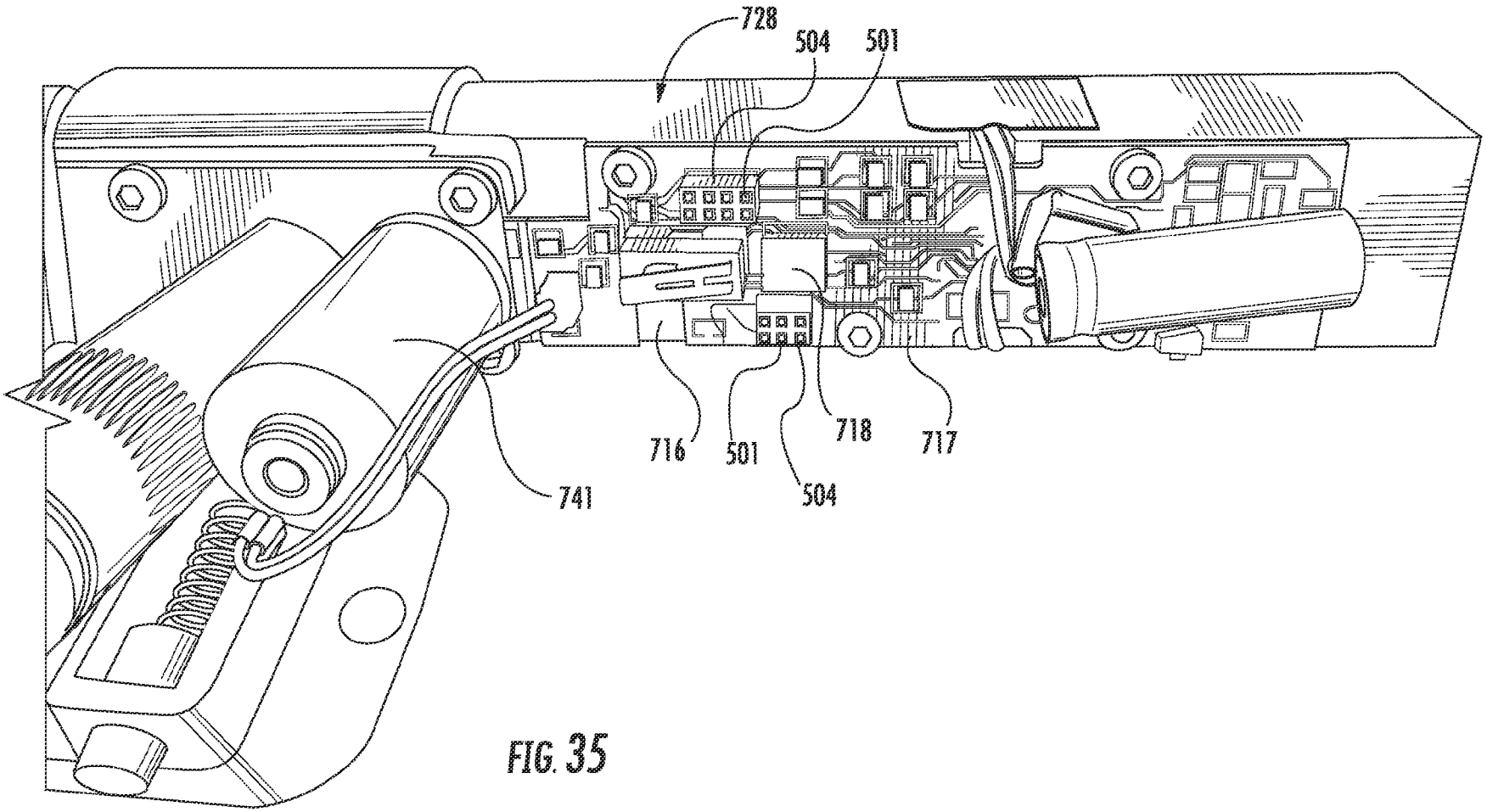
FIG. 35 shows the underside of an exemplary firing assembly of an exemplary compressed gas gun according to the present invention, showing the control circuitry.
Figure 36:
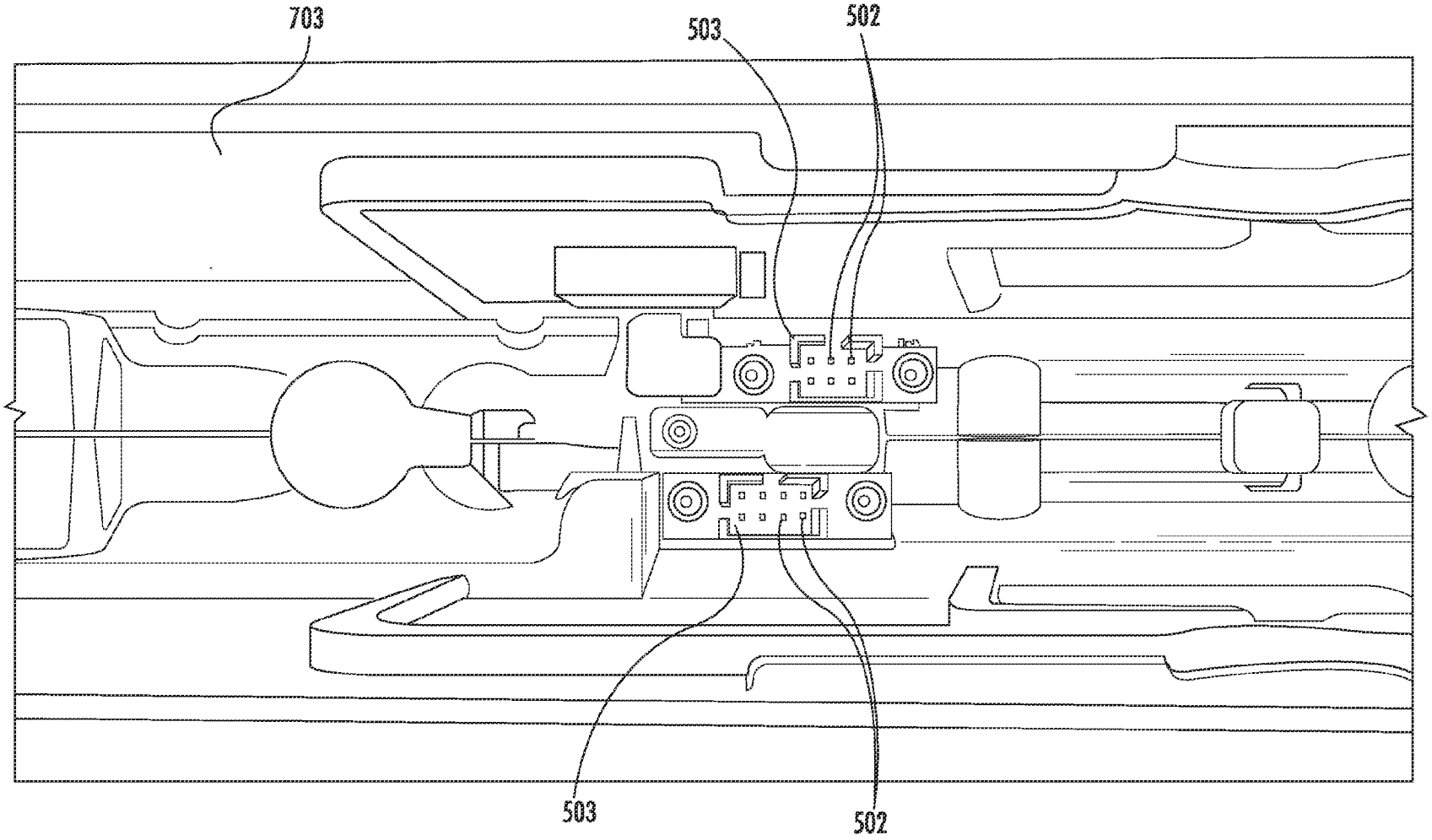
FIG. 36 shows the inside of an exemplary compressed gas gun according to the present invention, showing the interior space where the firing assembly may be removably attached.

Removal of the feed ramp 227 through the opening in the top of the gun exposes the firing assembly 728 of the compressed gas gun, as shown in FIG. 32. As shown in FIGS. 35-36, the firing assembly 728 may be held in place by hand or finger-removable attachment portions 504 that may include attachment slots 501, and attachment portions 504 in the interior 703 of the gun body that may include attachment pins 502, or snap fit into place. Once disengaged from any fittings, the firing assembly 728 can be lifted out of the body 701 as a single unit, as shown in FIGS. 33-34. Removal of the firing assembly 728 of allows for service, maintenance, adjustment, cleaning, etc. FIGS. 33 and 34 show the firing assembly 728 in the process of being removed from the body, and completely removed. The attachment portions 503, 504, which may attach by a friction fit and lock into place, and may be electrical junctions, that may further provide electrical connections for the control circuitry of the firing assembly and the power source (e.g., battery or batteries) of the gun.

The foregoing disassembly described can be accomplished according to the present invention, all without the use of tools. Re-assembly simply requires a reversal of the described disassembly.

A unique feature of a compressed gas gun according to the invention is the use of one control circuit for controlling operation of the both the firing assembly (solenoid, or compressed gas gun electronics), as well as the operation of the paintball loader (motor, or projectile feed mechanism electronics). The control circuitry of the compressed gas gun may be configured to control, operate, adjust, regulate and/or coordinate the compressed gas gun electronics and the loader electronics such that a more efficient, comprehensive compressed gas gun, which according to the invention includes an integral projectile feed mechanism, is provided. The control circuitry preferably includes a microprocessor and software for operation of the gun and monitoring, regulating, sensing, controlling, or otherwise accessing gun operations or parameters.

Figure 37:
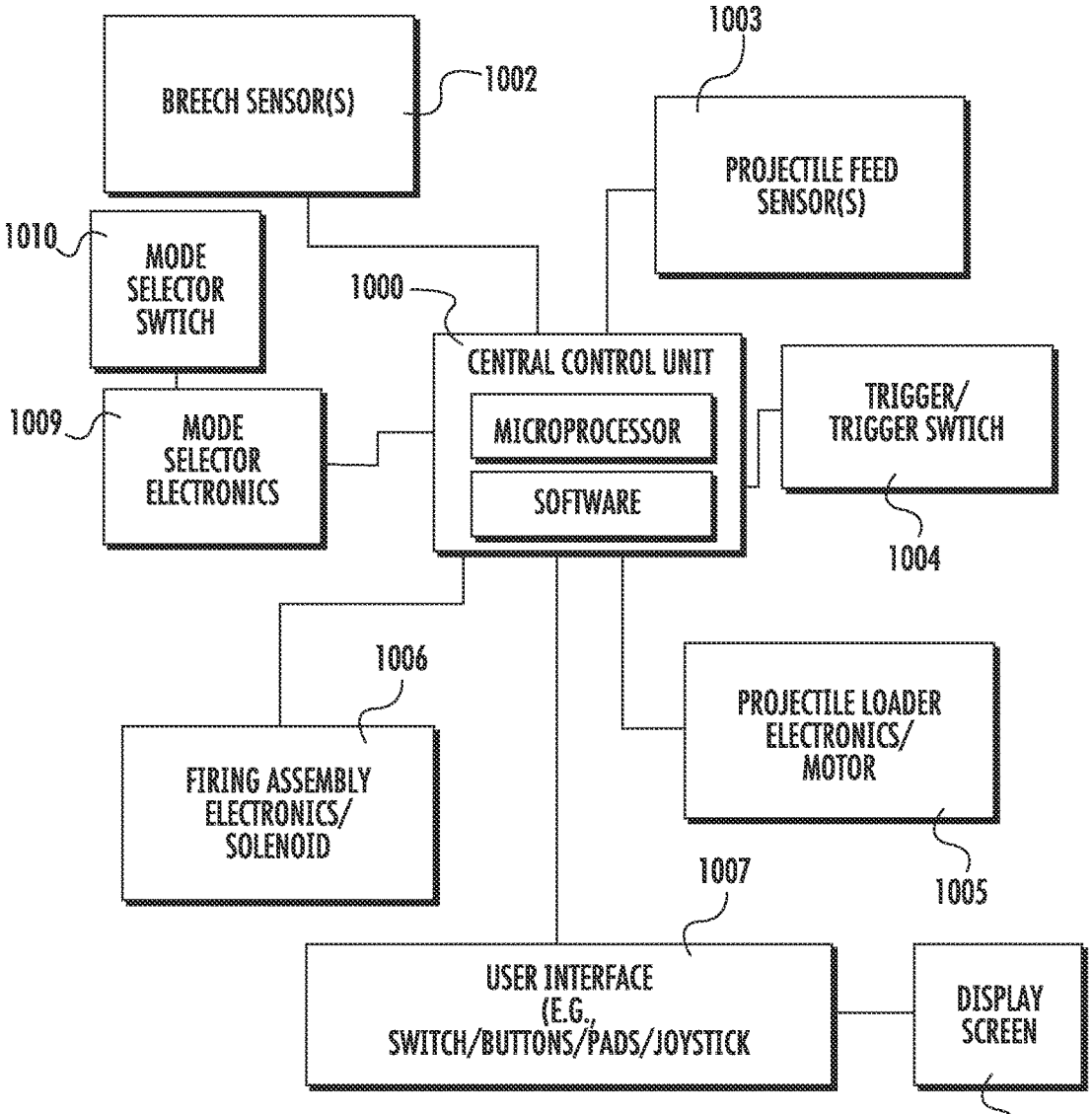
FIG. 37 shows a schematic of control circuitry and various sensors and electronics for an exemplary compressed gas gun according to the present invention.

FIG. 37 shows a schematic representation of the central control unit 1000 (or "central control circuitry" or "central control electronics", and which may include or comprise control unit 716), which may comprise a circuit board, electronics necessary for controlling operation of the compressed gas gun and projectile firing mechanism, and which may include a microprocessor and software for controlling and/or otherwise operating the compressed gas gun and projectile firing mechanism. As shown in FIG. 37, the central control unit 1000 is preferably in communication with a breech sensor or plurality of breech sensors 1002 (which may be sensors 814); a projectile feed mechanism sensor or plurality of projectile feed mechanism sensors 1003 (which may be sensors 782 and/or 784); a trigger switch 1004 actuated by pulling a trigger; the projectile feed mechanism motor and/or other projectile feed mechanism components and/or electronics 1005; the solenoid and/or firing assembly components and/or electronics 1006; and a user interface 1007. Preferably, the user interface 1007 includes user-actuable switches, buttons, pads, or a joystick, whereby a user can input selections to the software of the control circuitry, and may include a display screen 1008. The mode selector electronics 1009, which may include a mode selector switch 1010, and also in communication with and controlled by the central control unit 1000.

The central control unit 1000, which preferably includes a microprocessor and software, is preferably in communication with one or more sensors 1002 in the breech of the compressed gas gun, and one or more sensors 1003 in the projectile feed mechanism. The control unit 1000 is further in communication with a trigger switch 1004. The control unit 1000 can receive and process signals received from the trigger switch 1004, breech sensor 1002 and/or the projectile feed mechanism sensors 1003. Because the projectile feed mechanism 747 and firing assembly 728 are controlled by the same central control unit 1000, the control circuitry can operate the functions of the compressed gas gun in a coordinated manner not previously available, taking into account multiple signals and feedback as provided by the various sensors 1002, 1003.

Examples of operation of the control unit 1000 are described.

Upon actuation of the trigger, a firing signal may be sent by the trigger switch 1004 to the control unit 1000. The control unit 1000 is configured to process the firing signal and operate or otherwise control the firing assembly 728 and the projectile feed mechanism 747.

The control unit 1000 can transmit a firing assembly signal to a solenoid valve 731 that is part of the firing assembly 728. The solenoid valve 731 acts to operate the bolt 730 to chamber and fire a projectile.

Either simultaneously with operation of the firing assembly, or as otherwise timed for optimal feed rates, the control unit 1000 can also be configured to transmit a feed mechanism signal to the electronics and/or motor of the projectile feed mechanism. The feed mechanism signal will cause the projectile feeder of the feed mechanism signal to rotate to feed projectiles along the feed ramp 227, and into the breech of the firing assembly 728 for firing.

Figure 38:
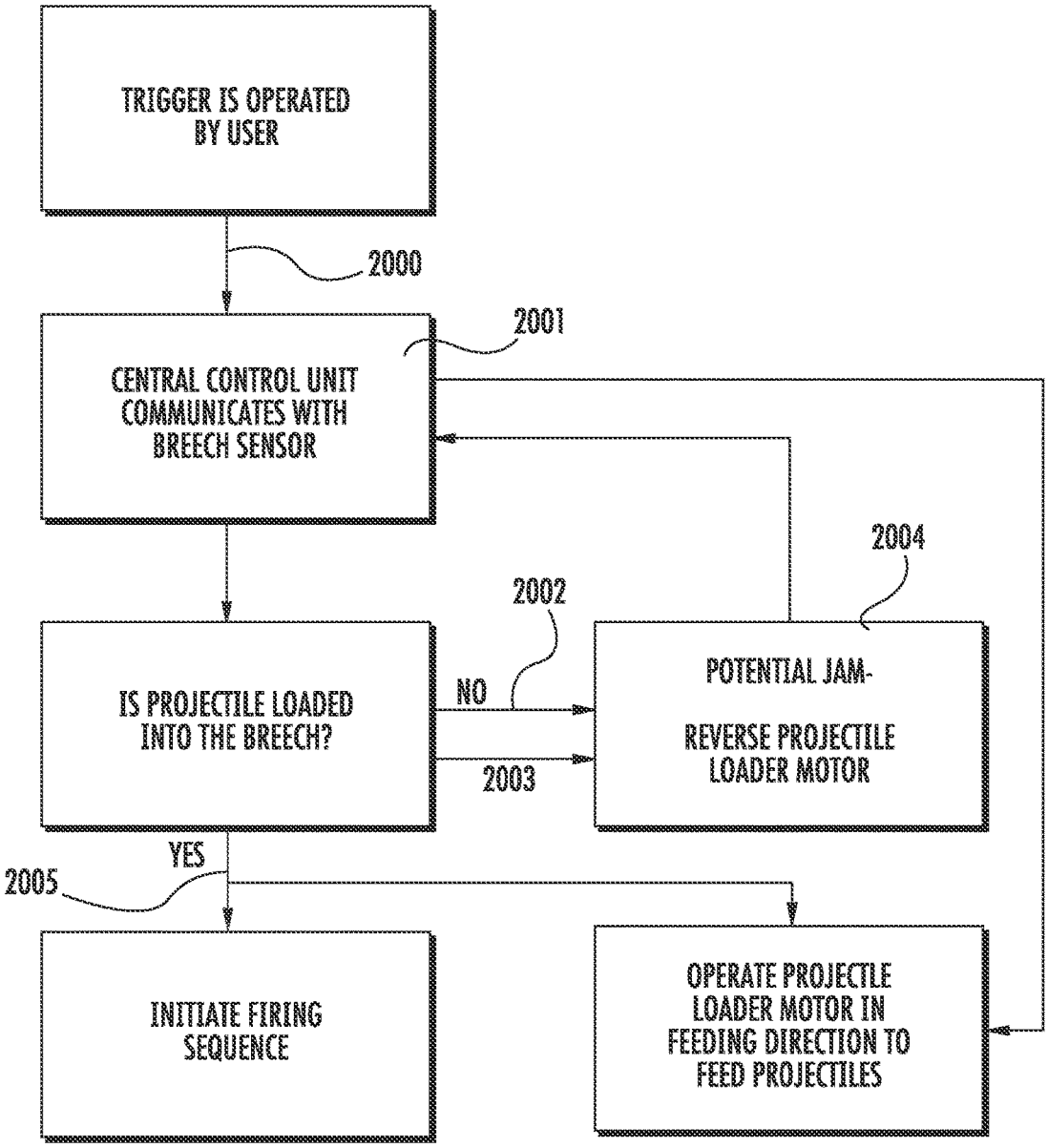
FIG. 38 shows a diagrammatic representation of the operation of exemplary control circuitry of an exemplary compressed gas gun according to the present invention.

FIG. 38 shows a flow chart diagramming a potential, illustrative operation of the central control unit 1000. When the trigger is actuated, operating the trigger switch 1004, a firing signal is sent to the control circuitry (2000). The control circuitry communicates with the breech sensor to determine whether the breech sensor detects that a projectile is properly loaded into the breech and ready for firing (2001). If a projectile is not detected in the breech by the breech sensor, or if a projectile is not fully in position in the breech whereby it could be "chopped," a "no projectile" signal may be transmitted to the control circuitry (2002). No paintballs in the breech, or a paintball improperly positioned in the breech, may be indicative of a paintball jam, that is, a misfed paintball. Because the control circuitry also controls the paintball loader, the "no projectile" signal may be received by the control circuitry, and a "jam clear" signal may be sent to the paintball loader (2003). This may cause the motor of the paintball loader to either operate in reverse, or in a reverse and forward manner, in an attempt to clear the jammed paintball (2004). Normal operations may resume once projectiles are detected, for example in the proper position, by the breech sensor (2005).

If a projectile is correctly positioned in the breech, the control circuitry may send a simultaneous, or otherwise timed, signal to the solenoid to operate and for the motor of the projectile feed mechanism motor to operate, thereby firing the gun and also simultaneously feeding projectiles (2006).

Thus, a central control circuit, housed in the same body as the firing assembly and the projectile feed mechanism, can gather operational parameters of the gun, which comprises both the firing assembly and the projectile feed mechanism, send operational signals to the firing assembly and the projectile loader, and coordinate and control operation of the firing assembly and the projectile feed mechanism to provide for an efficient, coordinated and improved operation. Thus, a single electronics platform is provided for both the firing assembly and the projectile feed mechanism.

The control unit 1000 may be configured to provide for controlled feeding of projectiles, where the speed of the feed rate of the projectile feed mechanism is regulated based upon how quickly or slowly projectiles are being fired. Thus, the speed of the motor of the projectile feed mechanism can be sped up or slowed down to coordinate with the rate of fire. In addition, by use of a single unit of control circuitry for both the firing assembly and the projectile feed mechanism, a single battery or battery pack can be used to power the compressed gas gun according to the present invention. For example, a single power source (battery pack) may power the control circuitry, the solenoid of the firing assembly, and the motor of the projectile feed mechanism.

An additional feature of the control circuitry may be the ability to clear the feed ramp when the gun is powered "off," such as by an ON/OFF power switch in communication with the power source (batteries). When a power switch of the user interface of the gun is set to "off," the control circuitry sends a "power off" signal to the motor of the projectile loader. The motor operates the feeder in reverse, to clear the projectiles in the feed ramp and adjacent the breech. In typical compressed gas gun where the loader or hopper is a separate unit attached to the top of the gun body, a user will remove the loader to make sure there is no balls in the breech or feedneck. With the projectile loader integrated into the gun, reversing the motor of the loader assists in removing projectiles from a feeding or firing position.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A compressed gas gun comprising:

a compressed gas gun body including a common interior area;

a firing assembly comprising a bolt, the firing assembly entirely housed within the interior area; and an internal, built-in projectile feed mechanism comprising a movable feeder housed entirely within the interior area with the firing assembly, the projectile feed mechanism configured to feed projectiles to the firing assembly via a feed ramp positioned between the projectile feed mechanism and the firing assembly, the feed ramp comprising a first end adjacent the projectile feed mechanism and a second end adjacent a breech area of the compressed gas gun, the entirety of the feed ramp housed within the interior area.

2. The compressed gas gun of claim 1, wherein the projectile feed mechanism is in a lower horizontal plane than the firing assembly when the gun is held in a firing position.

3. The compressed gas gun of claim 1, wherein the projectile feed mechanism is in a rear portion of the gun body, and wherein the rear portion is a butt stock of a rifle-shaped compressed gas gun.

4. The compressed gas gun of claim 1, further comprising a central control unit, the central control unit controlling operation of both the firing assembly and the projectile feed mechanism.

5. The compressed gas gun of claim 1, wherein the feed ramp has a portion positioned above the firing assembly, and wherein projectiles are fed from the feed ramp to the firing assembly from above the firing assembly.

6. The compressed gas gun of claim 1, wherein at least a portion of the feed ramp is detachable and removable through an opening in the top of the gun body.

7. The compressed gas gun of claim 1, wherein the feed ramp includes a first curved portion allowing for transition of projectiles from a first feeding direction to a second feeding direction.

8. The compressed gas gun of claim 7, wherein the feed ramp further includes a second curved portion allowing for transition of projectiles from the second feeding direction to a third feeding direction.

9. The compressed gas gun of claim 1, wherein the feed ramp comprises an S-shaped portion.

10. The compressed gas gun of claim 1, wherein the gun body further comprises an upper wall running the length of the interior area, and wherein the upper wall covers the firing assembly, projectile feed mechanism, and the feed ramp.

* * * * *